US007760178B2

(12) United States Patent
Takada et al.

(10) Patent No.: US 7,760,178 B2
(45) Date of Patent: Jul. 20, 2010

(54) DISPLAY DRIVER

(75) Inventors: Naoki Takada, Yokohama (JP); Yasuyuki Kudo, Fujisawa (JP); Takuya Eriguchi, Yokosuka (JP); Akihito Akai, Yokohama (JP); Kazuo Okado, Kokubungi (JP)

(73) Assignee: Renesas Technology Corp., Tokyo (JP)

( * ) Notice: Subject to any disclaimer, the term of this patent is extended or adjusted under 35 U.S.C. 154(b) by 1223 days.

(21) Appl. No.: 11/255,152

(22) Filed: Oct. 21, 2005

(65) Prior Publication Data

US 2006/0087483 A1 Apr. 27, 2006

(30) Foreign Application Priority Data

Oct. 22, 2004 (JP) ..... 2004-307779
Mar. 31, 2005 (JP) ..... 2005-100338

(51) Int. Cl.
*G09G 3/36* (2006.01)

(52) U.S. Cl. ..... 345/89; 345/77; 345/690

(58) Field of Classification Search ..... 341/154; 345/690, 89, 77, 87, 88, 98
See application file for complete search history.

(56) References Cited

U.S. PATENT DOCUMENTS 5,754,150 A * 5/1998 Matsui ..... 345/89
6,275,207 B1 * 8/2001 Nitta et al. ..... 345/89
2002/0186230 A1 12/2002 Kudo et al.
2002/0186231 A1 * 12/2002 Kudo et al. ..... 345/690
2002/0195955 A1 * 12/2002 Kudo et al. ..... 315/169.1
2003/0132906 A1 * 7/2003 Tanaka et al. ..... 345/89
2003/0151617 A1 * 8/2003 Morita ..... 345/690

FOREIGN PATENT DOCUMENTS

JP 2002-366112 12/2002

* cited by examiner

*Primary Examiner*—Amare Mengistu
*Assistant Examiner*—Koosha Sharifi
(74) *Attorney, Agent, or Firm*—Antonelli, Terry, Stout & Kraus, LLP.

(57) ABSTRACT

A liquid crystal display is provided with: a tap adjustment register for adjusting a gray scale level to a gray scale voltage in intermediate portions close to the end portions of the gamma characteristic; and a partial-voltage-ratio adjustment register for adjusting a ratio of a gray scale voltage among a plurality of gray scale levels in the intermediate portions close to the end portions of the gamma characteristic, in addition to an amplitude adjustment register for adjusting an amplitude of a gamma characteristic which determines a relation between gray scale levels and gray scale voltages or brightness levels on a display panel; a gradient adjustment register for adjusting a gradient of intermediate portions of the gamma characteristic while fixing end portions of the gamma characteristic; and a fine adjustment register for finely adjusting the intermediate portions of the gamma characteristic for each gray scale level.

25 Claims, 12 Drawing Sheets

TAP ADJUSTMENT

PARTIAL-VOLTAGE-RATIO ADJUSTMENT

AMPLITUDE ADJUSTMENT

GRADIENT ADJUSTMENT

FINE ADJUSTMENT

*FIG. 11*

| CURVE ADJUSTMENT REGISTER VALUE | VARIABLE RESISTANCE (912~918) | VARIABLE RESISTANCE (919~925) | VARIABLE RESISTANCE 926 | VARIABLE RESISTANCE 927 |
|---|---|---|---|---|
| 000 | IN 4R INCREMENTS | IN 1R INCREMENTS | 0R | 0R |
| 001 | IN 3R INCREMENTS | IN 2R INCREMENTS | 0R | 0R |
| 010 | IN 2R INCREMENTS | IN 3R INCREMENTS | 0R | 0R |
| 011 | IN 1R INCREMENTS | IN 4R INCREMENTS | 0R | 0R |
| 100 | IN 2R INCREMENTS | IN 1R INCREMENTS | 14R | 0R |
| 101 | IN 1R INCREMENTS | IN 2R INCREMENTS | 0R | 14R |

R : UNIT RESISTANCE VALUE

DISPLAY DRIVER

CROSS-REFERENCE TO RELATED APPLICATION

The present application claims priority from Japanese Patent Application No. JP 2004-307779 filed on Oct. 22, 2004 and Japanese Patent Application No. JP 2005-100338 filed on Mar. 31, 2005, the contents of which are hereby incorporated by reference into this application.

TECHNICAL FIELD OF THE INVENTION

The present invention relates to a display driver for outputting a gray scale voltage corresponding to display data representing the gray scale to a display panel in which a plurality of pixels are arranged, for example, a driver for an active matrix type display using a TFT liquid crystal display or the like. More particularly, it relates to a technology effectively applied to a driver circuit capable of adjusting various gamma characteristics with a small-scale circuitry.

BACKGROUND OF THE INVENTION

According to studies by the inventors of the present invention, technologies described below are applicable to display drivers.

For example, in an active matrix type liquid crystal display in which a display brightness level is controlled by a gray scale voltage to be applied, a display brightness characteristic with respect to gray scale data, that is, the so-called gamma characteristic has to be adjusted in order to achieve accurate color reproduction. Here, US Patent Publication No. 2002-186230 (JP-A-2002-366112, Patent Document 1) describes a liquid crystal display having means for adjusting a gamma characteristic incorporated in a driver circuit. This liquid crystal display adjusts a relation of a gray scale voltage with respect to display data (hereinafter, referred to as a gray scale number-gray scale voltage characteristic) by using three types of means, that is, amplitude adjustment, gradient adjustment, and fine adjustment. This makes it possible to achieve the adjustment of the gamma characteristic in accordance with individual characteristics of liquid crystal panels relatively easily.

SUMMARY OF THE INVENTION

Incidentally, studies by the inventors regarding the display drivers as described above have revealed the following problems.

For example, a gray scale number-gray scale voltage characteristic is represented by an S curve having so-called shoulder portions close to a reference voltage and the ground, respectively. In general, the optimal curve of such shoulder portions differs depending on the liquid crystal panel to be used. Therefore, for the application to various types of liquid crystal panels, a wide margin of adjustment is required. Here, in the function to adjust the gamma characteristic disclosed in the Patent Document 1, the shoulder portions are adjusted by using a fine adjustment circuit. However, depending on the panel to be used, the range of adjustment is insufficient, and therefore, a desired gamma characteristic cannot be obtained in some cases.

Therefore, an object of the present invention is to provide a display driver capable of achieving a function which can extend an adjustable range of the shoulder portions, thereby achieving accurate color reproducibility on more various types of display panels.

The typical ones of the inventions disclosed in this application will be briefly described as follows.

The display driver according to the present invention is applied to a display driver for outputting a gray scale voltage corresponding to display data representing a gray scale level to a display panel in which a plurality of pixels are arranged, and has features as described below.

(1) The display driver includes: a generating circuit for generating a plurality of gray scale voltages corresponding to a plurality of gray scale levels by dividing a reference voltage; a decoder circuit (selector circuit, digital/analog converter circuit) for selecting a gray scale voltage corresponding to the display data from the plurality of gray scale voltages; a first register (amplitude adjustment register) for setting a first value for adjusting a dividing point or a dividing ratio of the reference voltage in order to adjust an amplitude of a gamma characteristic which determines a relation between the gray scale levels and the gray scale voltages or brightness levels on the display panel; a second register (gradient adjustment register) for setting a second value for adjusting the dividing point or the dividing ratio of the reference voltage in order to adjust a gradient of intermediate portions of the gamma characteristic while fixing the end portions of the gamma characteristic; and a third register (fine adjustment register) for setting a third value for adjusting the dividing point or the dividing ratio of the reference voltage in order to finely adjust the intermediate portions of the gamma characteristic for each gray scale level, and further, a fourth register (tap adjustment register) for setting a fourth value for adjusting the dividing point or the dividing ratio of the reference voltage in order to adjust a gray scale level with respect to a gray scale voltage in intermediate portions close to end portions of the gamma characteristic; and a fifth register (partial-voltage-ratio adjustment register) for setting a fifth value for adjusting the dividing point or the dividing ratio of the reference voltage in order to adjust a gray scale voltage ratio among a plurality of gray scale levels in the intermediate portions close to both end portions of the gamma characteristic.

(2) The values of the first to fifth registers can be set independently from outside.

(3) The gamma characteristic is represented by an approximately S curve. The fourth register can adjust a gray scale level with respect to a gray scale voltage in the intermediate portions of the gamma characteristic including curved points of the approximately S curve. The fifth register can adjust a gray scale voltage ratio among a plurality of gray scale levels in the intermediate portions of the gamma characteristic located between the curved points and the both ends of the approximately S curve.

(4) The generating circuit includes: a first ladder resistance connected between a connecting end of a first reference voltage and a connecting end of a second reference voltage; first variable resistances connected in series to the first ladder resistance at a position close to a side of the connecting end of the first reference voltage and a position close to a side of the connecting end of the second reference voltage; second variable resistances connected in series to the first ladder resistance in intermediate portions of the first ladder resistance; first selectors for selecting an output from the first ladder resistance; an amplifier connected to an output side of the first selectors; second selectors selecting an input of the decoder circuit to connect an output from the amplifier to the input; a second ladder resistance connected to a plurality of inputs of the decoder circuit; and third variable resistances connected in series to the second ladder resistance between the second ladder resistance and the inputs of the decoder circuit. Resistance values of the first variable resistances can be varied based on the first value in the first register. Resistance values of the second variable resistances can be varied based on the second value in the second register. The first selector can select an output from the first ladder resistance based on the third value in the third register. The second selector can select an input point of the decoder circuit based on the fourth value in the fourth register. Resistance values of the third variable resistances can be varied based on the fifth value in the fifth register.

(5) The generating circuit has two systems each including the first ladder resistance, the first variable resistances, the second variable resistances, and the first selectors, and further includes third selectors for selecting an output from the first selectors of the two systems to output the selected one to the amplifier. Resistance values of the first variable resistances of the two systems can be varied based on the first value in the first register and a sixth value in a sixth register which has the same function as the first register. Resistance values of the second variable resistances of the two systems can be varied based on the second value in the second register and a seventh value in a seventh register which has the same function as the second register. The first selectors of the two systems can select an output from the first ladder resistance based on the third value in the third register and an eighth value in an eighth register which has the same function as the third register. The third selector can select an output from the first selector based on a first switching signal. The two systems are alternately used at predetermined periods, and during a period in which one of the two systems is used, settings of the other system are switched to those corresponding to a next period.

(6) Periods in which the two systems are alternately used correspond to a positive polarity and a negative polarity in polarity inversion driving of a liquid crystal display.

(7) The polarity inversion driving of the liquid crystal display is any one of common inversion driving, column inversion driving, and dot inversion driving.

(8) The predetermined period of the two systems is a period divided into three corresponding to each color of R, G, and B in the operation of a color liquid crystal display. The generating circuit includes: the third selectors for selecting the output from the first selectors of the two systems; and fourth selectors for selecting a three-divided output from the third selectors to output the selected one to the amplifier. Resistance values of the first variable resistances of the three-divided two systems can be varied based on the first value in the first register, the sixth value in the sixth register, and ninth to twelfth values in ninth to twelfth registers which have the same function as the first register. Resistance values of the second variable resistances of the three-divided two systems can be varied based on the second value in the second register, the seventh value in the seventh register, and thirteenth to sixteenth values in thirteenth to sixteenth registers which have the same function as the second register. The first selectors of the three-divided two systems can select an output from the first ladder resistance based on the third value in the third register, the eighth value in the eighth register, and seventeenth to twentieth values in seventeenth to twentieth registers which have the same function as the third register. The third selectors can select the output from the first selectors based on the first switching signal. The fourth selectors can select an output from the third selectors based on a second switching signal.

(9) The display driver further includes: a timing generating circuit for generating the first and second switching signals.

(10) A plurality of the first to third variable resistances are provided.

Also, the display driver according to the present invention has features as described below.

(11) The display driver includes: a first ladder resistance formed of a plurality of resistances connected in series between a first reference voltage and a second reference voltage; and a plurality of amplifiers having inputs connected to a plurality of connecting points of the plurality of resistances of the first ladder resistance, wherein one end of a first resistance is connected to an output of a first amplifier which outputs a voltage closest to the first reference voltage among a plurality of outputs of the plurality of amplifiers, one end of a second resistance is connected to an output of a second amplifier which outputs a voltage closest to the second reference voltage among the plurality of outputs of the plurality of amplifiers, a second ladder resistance having a plurality of resistances connected in series between the other end of the first resistance and the other end of the second resistance is connected, a plurality of output voltages from the plurality of amplifiers except the first amplifier and the second amplifier are applied to a plurality of common connecting points selected by a plurality of selectors from a plurality of common connecting points among the plurality of resistances connected in series in the second ladder resistance, and a gray scale voltage for driving a liquid crystal display is generated based on voltages of an output of the first amplifier, an output of the second amplifier, and outputs of the plurality of common connecting points of the plurality of resistances in the second ladder resistance.

Furthermore, the display driver according to the present invention has features as described below.

(12) The display driver includes: a first ladder resistance formed of a plurality of resistances connected in series between a first reference voltage and a second reference voltage; and a plurality of amplifiers having inputs connected to a plurality of connecting points of the plurality of resistances of the first ladder resistance, wherein one end of a first resistance is connected to an output of a first amplifier which outputs a voltage closest to the first reference voltage among a plurality of outputs of the plurality of amplifiers, one end of a second resistance is connected to an output of a second amplifier which outputs a voltage closest to the second reference voltage among the plurality of outputs of the plurality of amplifiers, a second ladder resistance having a plurality of resistances connected in series between the other end of the first resistance and the other end of the second resistance is connected, resistance values of the first resistance and the second resistance can be adjusted by registers, and a gray scale voltage for driving a liquid crystal display is generated based on voltages of an output of the first amplifier, an output of the second amplifier, and a plurality of common connecting points of the plurality of resistances in the second ladder resistance.

Also, the display driver according to the present invention has features as described below.

(13) The display driver includes: a generating circuit for generating a plurality of internally-generated reference voltages by dividing a reference voltage and generating a plurality of gray scale voltages corresponding to a plurality of gray scale levels by dividing the plurality of internally-generated reference voltages; a decoder circuit for selecting a gray scale voltage corresponding to the display data from the plurality of gray scale voltages; a first register (amplitude adjustment register) for setting a first value for adjusting a dividing point or a dividing ratio of the reference voltage in order to adjust an amplitude of a gamma characteristic which determines a relation between the gray scale levels and the gray scale voltages or brightness levels on the display panel; a second register (gradient adjustment register) for setting a second control value for adjusting the dividing point or the dividing ratio of the reference voltage in order to adjust a gradient of intermediate portions of the gamma characteristic; a third register (fine adjustment register) for setting a third value for adjusting the dividing point or the dividing ratio of the reference voltage in order to finely adjust the intermediate portions of the gamma characteristic for each gray scale level; and a fourth register (curve adjustment register) for setting a fourth value for adjusting the dividing point or the dividing ratio of the reference voltage in order to adjust a setting range of the third value for adjusting the gamma characteristic.

(14) The configuration and function similar to those described in (2) to (10) are provided.

The effect obtained by the representative one of the inventions disclosed in this application will be briefly described as follows.

According to the present invention, accuracy in adjustment of the gamma characteristic of a display using a liquid crystal panel or an organic EL panel in which the display brightness is controlled by an applied voltage can be improved. In particular, as for the adjustment of the gamma characteristic close to the reference voltage and ground, which has conventionally been difficult, since settings can be easily done through register control, it is possible to achieve general-purpose control with high image quality over various types of display panels.

BRIEF DESCRIPTIONS OF THE DRAWINGS

Figure 12:
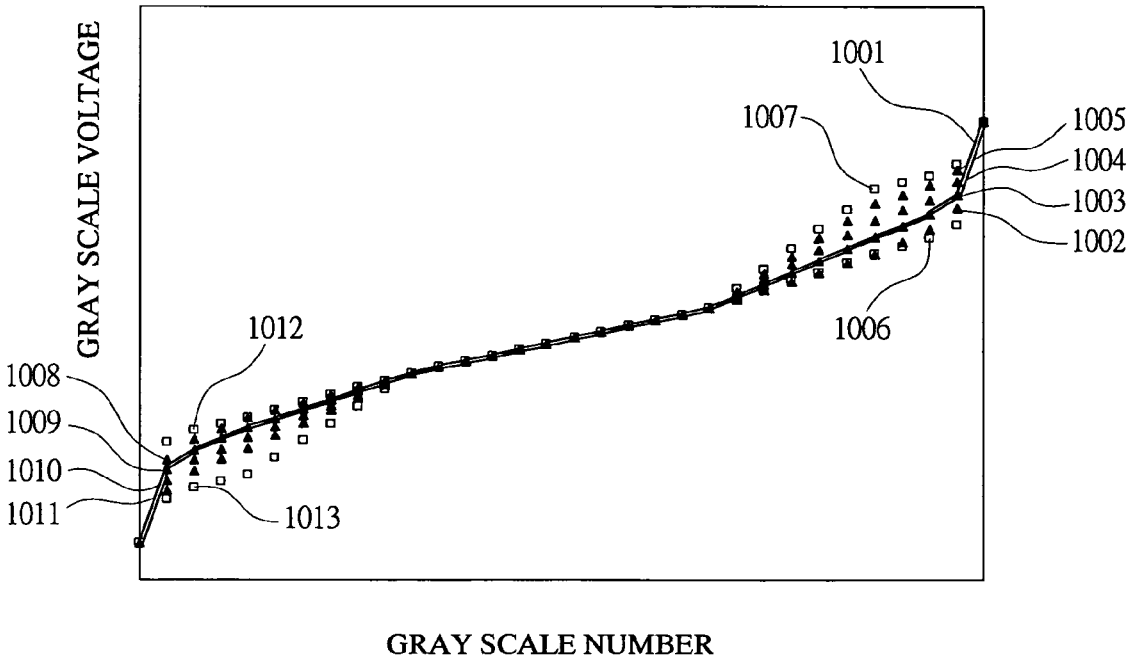

FIG. 11 is a table that depicts a relation between a curve adjustment register value and a variable resistance value in the liquid crystal display according to the fourth embodiment of the present invention; and FIG. 12 is a graph that depicts changes in a gray scale number-gray scale voltage characteristic by a curve adjustment function in the liquid crystal display according to the fourth embodiment of the present invention.

DESCRIPTIONS OF THE PREFERRED EMBODIMENTS

Hereinafter, embodiments of the present invention will be described in detail with reference to the accompanying drawings. Note that components having the same function are denoted by the same reference symbols throughout the drawings for describing the embodiment, and the repetitive description thereof will be omitted.

In the following embodiments, a liquid crystal display that displays an image in a normally black mode is described as an example of a display for which the display driver according to the present invention is used. However, needless to say, the present invention can also be applied to a liquid crystal display that displays an image in a normally white mode by changing its pixel configuration. Furthermore, the present invention can be applied not only to a liquid crystal display but also to an organic electroluminescence (EL) display and a field emission display (FED).

First Embodiment

A liquid crystal display according to a first embodiment of the present invention will be described with reference to FIG. 1 to FIG. 3.

In this embodiment, a liquid crystal display having the gamma characteristic adjustment function is newly provided with a tap adjustment function and a partial-voltage-ratio adjustment function in addition to the gamma characteristic adjustment functions of the conventional technology described in the above-mentioned Patent Document 1, that is, an amplitude adjustment function, a gradient adjustment function, and a fine adjustment function. With this, the so-called shoulder portions of an S curve close to a reference voltage and the ground whose adjustment has conventionally been particularly difficult by the conventional adjustment functions can be adjusted more flexibly than ever before. By doing so, a desired gray scale voltage can be obtained. Thus, an object of the present invention is to achieve accurate color reproducibility for various types of liquid panels.

That is, in the circuit configuration disclosed in the above-mentioned Patent Document 1, although a voltage outputted from the amplifier circuit (hereinafter referred to as a tap voltage) can be sufficiently adjusted, a partial voltage of the tap voltage by the second ladder resistance cannot be flexibly adjusted because the second ladder resistance is fixed. In view of this, if the voltage divided by the second ladder resistance can be made adjustable, flexibility of voltage adjustment will be extended, and the object of the present invention can be achieved.

Therefore, in the liquid crystal display according to the first embodiment, a function to change the position of a gamma tap connected to the second ladder resistance and a function to change a partial voltage ratio of the second ladder resistance are newly provided. By doing so, in comparison with the conventional gamma characteristic adjustment function, a function to extend the adjustable range of the shoulder portions can be achieved. Consequently, it is possible to achieve the accurate color reproducibility on more various liquid crystal panels. Specific descriptions will be provided below.

First, with reference to FIG. 1, an example of the configuration of a gray-scale-voltage generating unit in the liquid crystal display according to this embodiment will be described. FIG. 1 is a block diagram showing the configuration of the gray-scale-voltage generating unit.

The gray-scale-voltage generating unit in the liquid crystal display according to the first embodiment includes: a gray-scale-voltage generating circuit 100 for generating a plurality of gray scale voltages corresponding to a plurality of gray scale levels by dividing a reference voltage; a tap adjustment register 101 for setting a value for adjusting a dividing point or a dividing ratio of the reference voltage in order to adjust a gray scale level with respect to a gray scale voltage in intermediate portions of the gamma characteristic close to its both end portions; a partial-voltage-ratio adjustment register 102 for setting a value for adjusting the dividing point or the dividing ratio of the reference voltage in order to adjust a ratio of a gray scale voltage among a plurality of gray scale levels in the intermediate portions of the gamma characteristic close to its both end portions; an amplitude adjustment register 103 for setting a value for adjusting the dividing point or the dividing ratio of the reference voltage in order to adjust an amplitude of the gamma characteristic; a gradient adjustment register 104 for setting a value for adjusting the dividing point or the dividing ratio of the reference voltage in order to adjust a gradient of the intermediate portions of the gamma characteristic while fixing both end portions of the gamma characteristic; a fine adjustment register 105 for setting a value for adjusting the dividing point or the dividing ratio of the reference voltage in order to finely adjust the intermediate portions of the gamma characteristic by gray scale levels; and a decoder circuit 106 for selecting a gray scale voltage corresponding to display data from the plurality of gray scale voltages.

The gray-scale-voltage generating circuit 100 includes: a first ladder resistance formed of resistances 111 to 116 connected between a connecting end of the reference voltage and a connecting end of the ground; variable resistances 121 and 122 connected in series to the first ladder resistance on the side of the connecting end of the reference voltage and on the side of the connecting end of the ground, respectively; variable resistances 123 and 124 connected in series to the first ladder resistance at intermediate portions of the first ladder resistance; selectors (SELs) 131 to 136 for selecting an output from the first ladder resistance; an amplifier circuit 141 formed of amplifiers corresponding to these selectors 131 to 136 and connected to the output side of these selectors; a second ladder resistance formed of resistances 151 to 155 connected to a plurality of inputs of the decoder circuit 106; tap selectors (TAPSELs) 161 and 162 for selecting an input of the decoder circuit 106 and connecting an output from the amplifier circuit 141 to the selected input; and variable resistances 171 and 172 connected in series to the second ladder resistance each between the second ladder resistance and inputs to the decoder circuit 106.

This gray-scale-voltage generating circuit 100 has externally connected thereto the tap adjustment register 101, the partial-voltage-ratio adjustment register 102, the amplitude adjustment register 103, the gradient adjustment register 104, and the fine adjustment register 105.

In the configuration of the above-described gray-scale-voltage generating unit according to this embodiment, the tap selectors 161 and 162 and the variable resistances 171 and 172 are added to the gray-scale-voltage generating circuit 100 of the conventional technology of the above-mentioned Patent Document 1, and further, the tap adjustment register 101 and the partial-voltage-ratio adjustment register 102 are added thereto.

In the liquid crystal display according to this embodiment, the tap adjustment register 101 and the partial-voltage-ratio adjustment register 102 store setting values for adjusting the tap selectors 161 and 162 and those for adjusting the variable resistances 171 and 172 of the gray-scale-voltage generating circuit 100, respectively. The amplitude adjustment register 103 stores register values for adjusting the resistance values of the variable resistances 121 and 122. The gradient adjustment register 104 stores register values for adjusting the resistance values of the variable resistances 123 and 124. The fine adjustment register 105 stores register values for adjusting the selectors 131 to 136 that select a voltage level at the time of resistively dividing the resistances 111 to 116.

Also, the decoder circuit 106 is a circuit that decodes a gray scale voltage corresponding to the display data from gray scale voltages generated by the gray-scale-voltage generating circuit 100.

Next, an example of an operation of generating a gray scale voltage in the gray-scale-voltage generating unit according to this embodiment will be described with reference to FIG. 1.

A reference voltage 107 externally inputted with respect to the ground (GND) 108 is resistively divided by the first ladder resistance formed of the resistances 111 to 116, thereby generating desired gray scale voltages based on the settings of the variable resistances 121 to 124 and the selectors 131 to 136. In this embodiment, with the above-described configuration, eight voltage levels are generated. These generated voltage levels are hereinafter referred to as first to eighth reference voltages in order of higher to lower voltages. Here, similar to the conventional technology, the first to eighth reference voltages can be controlled by amplitude adjustment, gradient adjustment, and fine adjustment. Of these reference voltages, the first and eighth reference voltages (tap voltages 181 and 188) are directly outputted to the decoder circuit 106.

The second to seventh reference voltages are buffered by the amplifier circuit 141. The second to seventh reference voltages buffered by the amplifier circuit 141 are hereinafter respectively referred to as tap voltages 182 to 187. The tap voltages 182 to 187 are resistively divided by the second ladder resistance including the resistances 151 to 155. Of these tap voltages, the tap voltages 183 and 186 can change their tap destinations in the second ladder resistance by means of the tap selectors 161 and 162, respectively.

Here, the internal circuit configuration and circuit operation of the tap selectors 161 and 162 used in this embodiment will be described together with a relation between the tap adjustment register 101 and the tap selectors 161 and 162.

Although the internal configuration of the tap selector 161 (162) is not shown, it has a connection so that the tap voltage 183 (186) is outputted to connected points 191, 192, 193 and 194 (195, 196, 197 and 198) in the second ladder resistance.

Between the tap voltage 183 (186) and the connected points, select switches of two stages are provided.

First, a first select switch of a first stage selects either one of a first data line connecting the tap voltage 183 (186) to the connected point 191 or 192 (195 or 196) and a second data line connecting the tap voltage 183 (186) to the connected point 193 or 194 (197 or 198).

Next, a second select switch of a second stage selects either one of a data line connecting the first data line selected by the first select switch of the first stage to the connected point 191 (195) and a data line connecting the first data line to the connected point 192 (196). A third select switch of the second stage selects either one of a data line connecting the second data line selected by the first select switch to the connected point 193 (197) and a data line connecting the second data line to the connected point 194 (198).

The above-described first to third select switches are each composed of a 2-to-1 selector. At a register setting value of bit [0], an output of the first select switch of the first stage is selected. At a register setting value of bit [1], an output of the second and third select switches of the second stage is selected.

In this embodiment, when the register value of the tap adjustment register 101 is set as "100"[BIN], the tap selector 161 (162) selects the connected point 191 (195). Also, when the register value of the tap adjustment register 101 is set as "11"[BIN], the tap selector 161 (162) selects the connected point 194 (198).

Also, although the tap selectors 161 and 162 use the above-described configuration in this embodiment, the internal configuration may be changed according to need as long as a desired one of the connected points 191, 192, 193 and 194 (195, 196, 197 and 198) in the second ladder resistance can be selected as the output destination of the tap voltage 183 (186) and control can be made through the register settings in the configuration.

Also, in this embodiment, the tap selectors 161 and 162 can select one of four connected points. However, the number of points can be increased and decreased. Also, in this embodiment, tap destinations are selected from among successive gray scale numbers. Alternatively, tap destinations may be arbitrarily changed as required in a manner such that, for example, tap destinations can be selected from every other gray scale numbers.

Furthermore, the variable resistance 171 is located between the second ladder resistance and the tap voltage 182, and the variable resistance 172 is located between the second ladder resistance and the tap voltage 187. The resistance values of the variable resistances 171 and 172 can be changed by the settings of the partial-voltage-ratio adjustment register 102.

By varying the value of the variable resistance 171, a resistive partial voltage ratio between the tap voltage 182 and the connected point for the tap voltage 183 selected by the tap selector 161 can be varied, and by varying the value of the variable resistance 172, a resistive partial voltage ratio between the tap voltage 186 and the connected point for the tap voltage 187 selected by the tap selector 162 can be varied.

The eight tap voltages 181 to 188 are resistively divided by the second ladder resistance in the above-described manner, thereby generating gray scale voltages for the required gray scale levels (in this embodiment, 32 levels of gray scales are generated by way of example).

At this time, a so-called shoulder curve of the gamma characteristic can be changed in detail by the settings of the tap selectors 161 and 162 and the variable resistances 171 and 172 for the tap voltages 181 to 188.

First, with reference to FIG. 2A, an example of effects of the tap adjustment function will be described. FIG. 2A is a graph showing the gray scale number-gray scale voltage characteristic.

In FIG. 2A, 201 denotes a graph showing the gray scale number-gray scale voltage characteristic when various register settings are at their defaults. The above-described tap voltages 181 to 188 correspond to points 202 to 209, respectively, on this graph.

Figure 1:
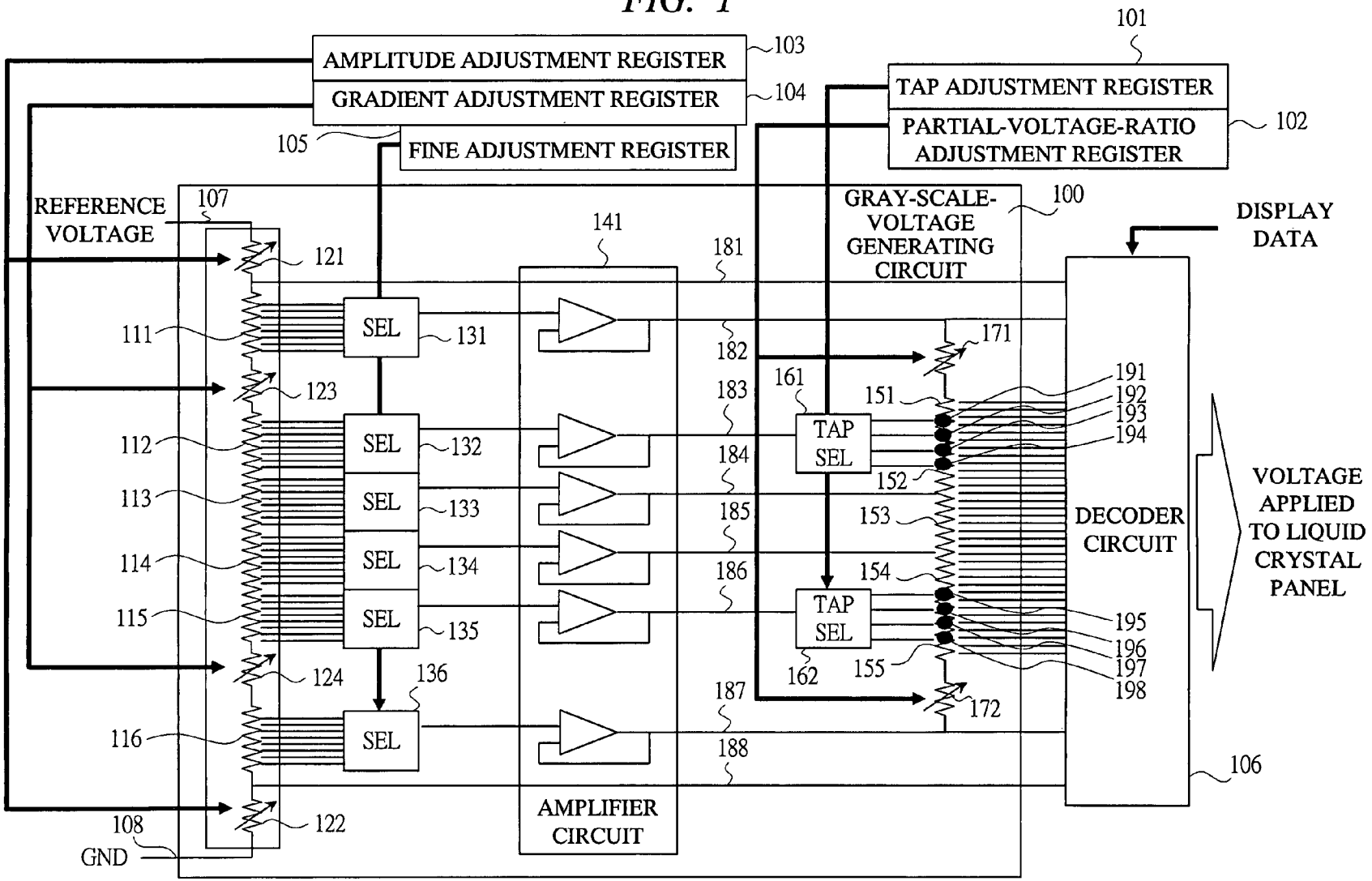
FIG. 1 is a block diagram showing the configuration of the gray-scale-voltage generating unit in a liquid crystal display according to a first embodiment of the present invention.
Figure 2A:
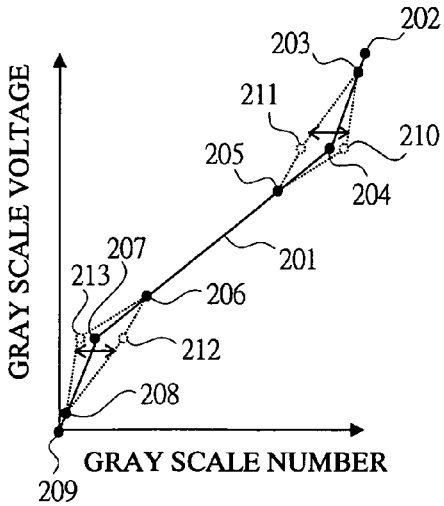
FIG. 2A is a drawing showing the effects of a tap adjustment function on a gamma characteristic in the liquid crystal display according to the first embodiment of the present invention.
Figure 2B:
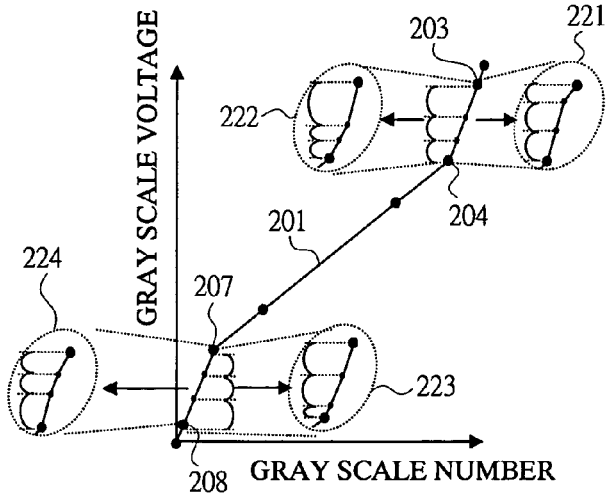
FIG. 2B is a drawing showing the effects of a partial-voltage-ratio adjustment function on a gamma characteristic in the liquid crystal display according to the first embodiment of the present invention.

Now, in the gray-scale-voltage generating unit of FIG. 1, when the tap selector 161 and the tap adjustment register 101 are set so that the selected destination of the tap voltage 183 becomes the connected point 191, the graph 201 in FIG. 2A is changed so that the point 204 on the graph is moved to the point 210. Also, when the tap selector 161 and the tap adjustment register 101 are set so that the selected destination of the tap voltage 183 becomes the connected point 194, the graph 201 in FIG. 2A is changed so that the point 204 on the graph is moved to the point 211.

Similarly, in the gray-scale-voltage generating unit of FIG. 1, when the tap selector 162 and the tap adjustment register 101 are set so that the selected destination of the tap voltage 186 becomes the connected point 195, the graph 201 in FIG. 2A is changed so that the point 207 on the graph is moved to the point 212. Also, when the tap selector 162 and the tap adjustment register 101 are set so that the selected destination of the tap voltage 186 becomes the connected point 198, the graph 201 in FIG. 2A is changed so that the point 207 on the graph is moved to the point 213.

As described above, by the tap adjustment function, the points 204 and 207 on the graph showing the gray scale number-gray scale voltage characteristic can be changed in the horizontal direction. As a result, the curvature of the S curve representing the gamma characteristic can be controlled to be small or large.

Meanwhile, in the conventional technology, the shoulder portions in the S curve of the gamma characteristic are adjusted by a fine adjustment function. In this fine adjustment function, the points 202 to 209 on the graph showing the gray scale number-gray scale voltage characteristic can be individually adjusted in the vertical direction. In this case, particularly when the so-called shoulder portions of the S curve representing the gamma characteristic are adjusted, the points 203, 204 and 205 (206, 207 and 208) are adjusted in the vertical direction. By doing so, the curvature of the S curve can be controlled to be small or large.

In the conventional technology, however, the shoulder portions of the S curve representing the gamma characteristic can be adjusted only one-dimensionally, that is, the adjustment in the vertical direction. By contrast, in this embodiment, since adjustment in the horizontal direction by the tap adjustment function is added, two-dimensional adjustment is achieved. As a result, in comparison with the conventional adjustment function, a further wider range of adjustment can be achieved.

Also, if the fine adjustment function in the conventional technology is enhanced (for example, when the settable voltage range of the tap voltage is extended or when the selector settings are more detailed), the setting range of the points 202 to 209 on the graph can be extended. However, such settings are merely in the vertical direction on the graph, and therefore, it is impossible to provide a function similar to the tap adjustment function.

As described above, with the tap adjustment function, the magnitude of the so-called S curve representing the gamma characteristic can be varied.

Next, with reference to FIG. 2B, an example of effects of the partial-voltage-ratio adjustment function will be described. FIG. 2B is a graph showing the gray scale number-gray scale voltage characteristic.

In FIG. 2B, a graph 201 and points 202 to 209 are identical to those of FIG. 2A, and therefore are partially omitted.

Now, in the gray-scale-voltage generating unit of FIG. 1, when the partial-voltage-ratio adjustment register 102 is set so that the resistance value of the variable resistance 171 is reduced, the graph 201 in FIG. 2B is changed so that a partial voltage ratio between the points 203 and 204 on the graph becomes a partial voltage ratio represented in a dotted circle 221. Also, when the partial-voltage-ratio adjustment register 102 is set so that the resistance value of the variable resistance 171 is increased, the graph 201 in FIG. 2B is changed so that the partial voltage ratio between the points 203 and 204 on the graph becomes a partial voltage ratio represented in a dotted circle 222.

Similarly, in the gray-scale-voltage generating unit of FIG. 1, when the partial-voltage-ratio adjustment register 102 is set so that the resistance value of the variable resistance 172 is reduced, the graph 201 in FIG. 2B is changed so that a partial voltage ratio between the points 207 and 208 on the graph becomes a partial voltage ratio represented in a dotted circle 223. Also, when the partial-voltage-ratio adjustment register 102 is set so that the resistance value of the variable resistance 172 is increased, the graph 201 in FIG. 2B is changed so that the partial voltage ratio between the points 207 and 208 on the graph becomes a partial voltage ratio represented in a dotted circle 224.

As described above, in the partial-voltage-ratio adjustment function, by adjusting the variable resistances 171 and 172, the resistive division ratio between the points 203 and 204 and that between the points 207 and 208 are changed, and voltage settings of each gray scale number between the points 203 and 204 and between the points 207 and 208 can be changed.

Here, in the conventional technology, the gray scale voltage value between tap voltages is determined by the tap voltage values, and the resistive division ratio of the ladder resistance connecting between the tap voltages is fixed. Therefore, when it is intended to raise the gray scale voltage values between the points 203 and 204 (207 and 208), the points 203 and 204 (207 and 208) have to be raised. If the point 204 (207) is raised, the shoulder portion of the S curve representing the gamma characteristic is disadvantageously raised. Similarly, when it is intended to lower the gray scale voltage values between the points 203 and 204 (207 and 208), the points 203 and 204 (207 and 208) have to be lowered. If the point 204 (207) is lowered, the shoulder portion of the S curve representing the gamma characteristic is disadvantageously lowered.

By contrast, in the partial-voltage-ratio adjustment function according to this embodiment, the voltages close to the reference voltage and the ground can be set in a wider range without changing the S curve representing the gamma characteristic.

Also, even if the fine adjustment function in the conventional technology is enhanced, the shoulder portions of the S curve representing the gamma characteristic are deformed for the reason described above. Therefore, it is impossible to achieve a function similar to the partial-voltage-ratio adjustment function by enhancing the fine adjustment function.

As described above, with the partial-voltage-ratio adjustment function, the voltages close to the reference voltage and the ground can be set in a wider range.

In the above, effects of the tap adjustment function and the partial-voltage-ratio adjustment function have been described. The effects of these two functions can be combined with the effects obtained by the conventional amplitude adjustment, gradient adjustment, and fine adjustment as shown in FIG. 2C to FIG. 2E.

That is, the variable resistances 121 and 122 of the gray-scale-voltage generating unit change the resistance values with reference to resistance value setting data included in the amplitude adjustment register 103, thereby adjusting the voltage values on both ends of gray scale numbers.

Figure 2C:
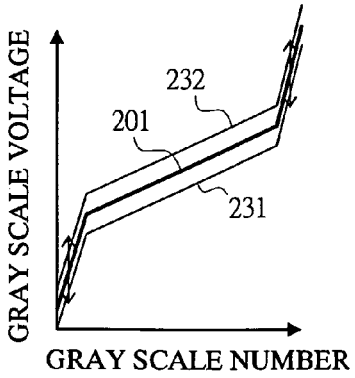
FIG. 2C is a drawing showing the effects of an amplitude adjustment function on a gamma characteristic in the liquid crystal display according to the first embodiment of the present invention.
Figure 2D:
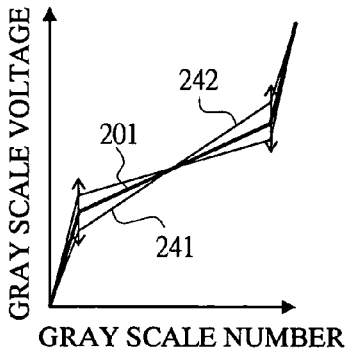
FIG. 2D is a drawing showing the effects of a gradient adjustment function on a gamma characteristic in the liquid crystal display according to the first embodiment of the present invention.
Figure 2E:
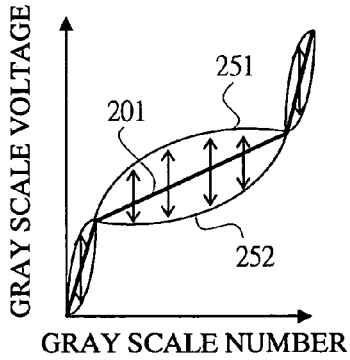
FIG. 2E is a drawing showing the effects of a fine adjustment function on a gamma characteristic in the liquid crystal display according to the first embodiment of the present invention.
Figure 3:
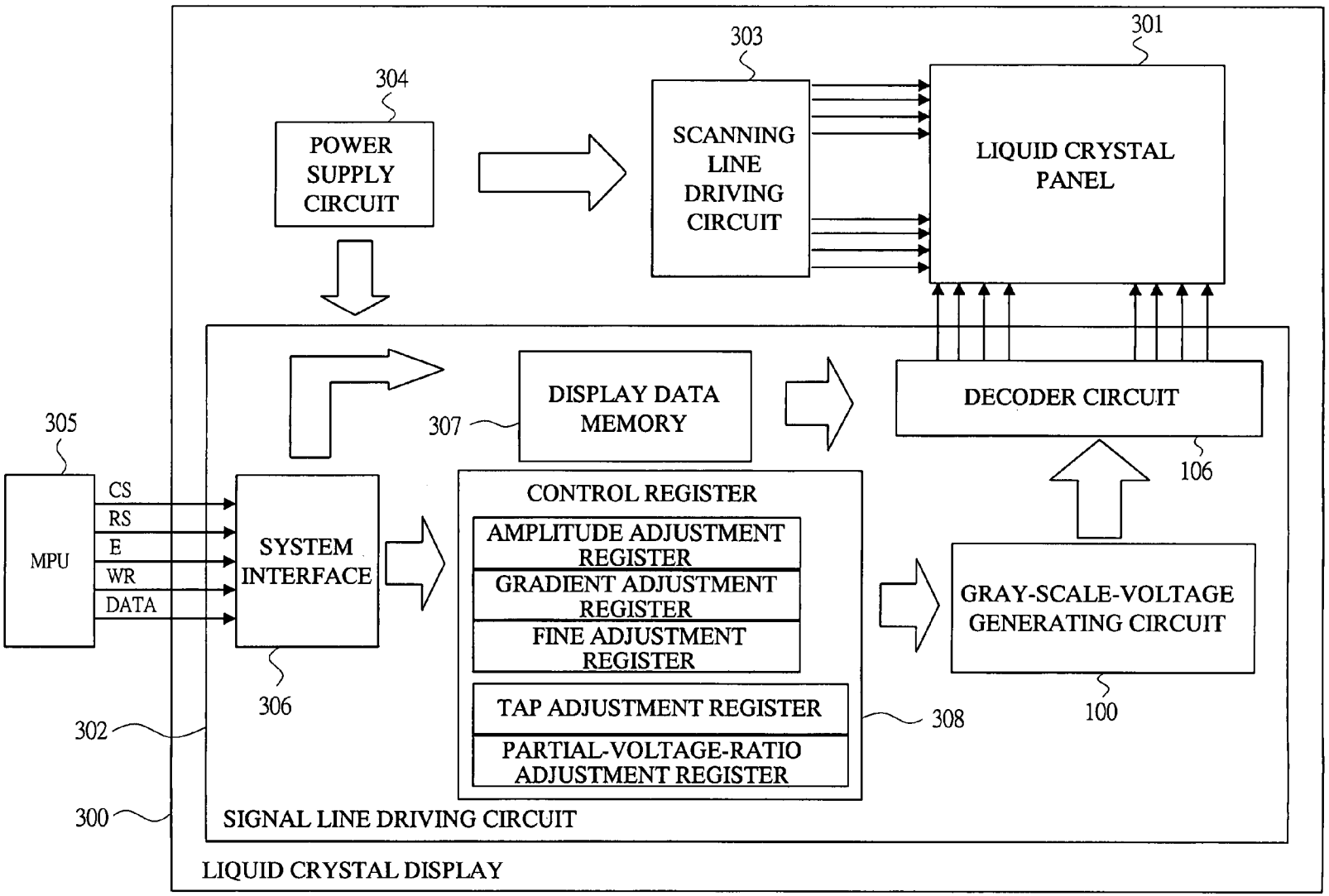
FIG. 3 is a block diagram showing a liquid crystal display according to the first embodiment of the present invention.

A gray scale number-gray scale voltage characteristic obtained from the results of this amplitude adjustment function is shown in FIG. 2C. In FIG. 2C, a graph 231 depicts the case where the resistance value of the variable resistance 121 is set to be larger and the resistance value of the variable resistance 122 is set to be smaller in comparison with default settings of the graph 201. Also, a graph 232 depicts the case where the resistance value of the variable resistance 121 is set to be smaller and the resistance value of the variable resistance 122 is set to be larger. In this manner, the amplitude voltage of the gray scale voltage can be adjusted.

Also, the variable resistances 123 and 124 of the gray-scale-voltage generating unit change the resistance values with reference to the resistance value setting data included in the gradient adjustment register 104, thereby adjusting a gradient characteristic of intermediate portions of the gray scale voltage.

A gray scale number-gray scale voltage characteristic obtained from the results of this gradient adjustment function is shown in FIG. 2D. In FIG. 2D, a graph 241 depicts the case where the resistance value of the variable resistance 123 is set to be smaller and the resistance value of the variable resistance 124 is set to be larger in comparison with default settings of the graph 201. Also, a graph 242 depicts the case where the resistance value of the variable resistance 123 is set to be larger and the resistance value of the variable resistance 124 is set to be smaller. In this manner, the intermediate level portion of the gray scale voltage can be adjusted.

Furthermore, the selectors 131 to 136 of the gray-scale-voltage generating unit select a desired gray scale voltage from the voltages obtained by the resistive division of the resistances 111 to 116 with reference to the setting values of the fine adjustment register 105, thereby performing fine adjustment.

A gray scale number-gray scale voltage characteristic obtained from the results of this fine adjustment function is shown in FIG. 2E. In FIG. 2E, a graph 251 depicts the case where, from the voltages selected by the selectors 131 to 136, that close to the reference voltage is selected in comparison with default settings of the graph 201. A graph 252 depicts the case where, from the voltages selected by the selectors 131 to 136, that close to the ground is selected. In this manner, the gray scale voltage can be finely adjusted.

As described above, by combining these functions, in addition to the conventional gamma characteristic adjustment function, a function capable of further extending the adjustable range in the so-called shoulder portions of the S curve representing the gamma characteristic can be achieved. Therefore, it is possible to achieve the accurate color reproducibility on more various display panels.

Next, with reference to FIG. 3, an example of the configuration of the liquid crystal display according to this embodiment equipped with the above-described gray-scale-voltage generating unit will be described. FIG. 3 is a block diagram showing the configuration of the liquid crystal display.

A liquid crystal display 300 according to this embodiment includes: a liquid crystal panel 301; a signal line driving circuit 302 equipped with the gray-scale-voltage generating unit of FIG. 1 that outputs a gray scale voltage corresponding to display data to a signal line of the liquid crystal panel 301; a scanning line driving circuit 303 for applying a scanning signal to a scanning line of the liquid crystal panel 301; and a power supply circuit 304 that supplies an operation power to the signal line driving circuit 302 and the scanning line driving circuit 303. The power supply voltage supplied from the power supply circuit 304 to the signal line driving circuit 302 includes the reference voltage shown in FIG. 1.

This liquid crystal display 300 has connected thereto a microprocessor unit (MPU) 305 that performs various processes for displaying an image on the liquid crystal panel 301.

The signal line driving circuit 302 includes: a system interface 306 for exchanging display data and control data with the MPU 305; a display data memory 307 for storing the display data outputted from the system interface 306; a control register 308 formed of various registers such as the tap adjustment register 101, the partial-voltage-ratio adjustment register 102, the amplitude adjustment register 103, the gradient adjustment register 104, and the fine adjustment register 105 shown in FIG. 1; the gray-scale-voltage generating circuit 100; and the decoder circuit 106.

Upon reception of the display data and instructions outputted from the MPU 305, the system interface 306 performs an operation of outputting these data and instructions to the control register 308. Details of this operation comply with, for example, a 68-system 16-bit bus interface, and these data and instructions include a Chip Select (CS) signal indicating chip selection, a Register Select (RS) signal for selecting whether an address or data in the control register 308 is to be specified, an Enable (E) signal for instructing the start of a process operation, a Write Read (WR) signal for selecting write or read of data, and a DATA signal indicating a setting value of an address or data in the control register 308.

Here, the instructions represent information for determining internal operations of the signal line driving circuit 302, the scanning line driving circuit 303, and the power supply circuit 304, and they include various parameters such as a frame frequency, the number of driven lines, and a driving voltage. The instructions also include information about amplitude adjustment, gradient adjustment, fine adjustment, tap adjustment, and partial-voltage-ratio adjustment, which are a feature of the present invention. Also, the control register 308 stores data of such instructions and outputs this to each block of these driving circuits.

In this manner, since the setting values of each register in the control register 308 can be easily varied independently from outside, the adjustment of each gamma characteristic is facilitated. Also, in addition to the conventional gamma characteristic adjustment function, a function capable of further extending the adjustable range of the so-called shoulder portions of the S curve representing the gamma characteristic can be achieved. Therefore, it is possible to achieve the accurate color reproducibility on more various display panels.

Note that, in this embodiment, the description has been made based on the use of the liquid crystal display 300. The application of the present invention is not limited to this, and this embodiment can be applied to other displays that control a display brightness level by a voltage to be applied, for example, an organic EL display and the like.

Also, in this embodiment, for the simplification of description, a concept regarding polarity inversion driving required for driving a liquid crystal display or the like is omitted. However, this embodiment can be easily applied to various methods such as common inversion, column inversion and dot inversion. Note that an application to common inversion driving will be described in detail further below in a second embodiment.

Furthermore, the number of bits of the display data is assumed herein as six, but the number is not limited to this.

Still further, in this embodiment, for the simplification of description, a concept of color is omitted. However, color display can be easily realized by, for example, constituting display data of one pixel with red (R), green (G), and blue (B), and applying a so-called vertical stripe configuration to a display portion. This application to red (R), green (G), and blue (B) will be described in detail further below in a third embodiment.

Still further, this embodiment has been described based on the premise that various types of information regarding gamma characteristic adjustment are stored in registers. However, the present invention is not limited to this and, for example, terminal settings may be used.

Second Embodiment

A liquid crystal display according to the second embodiment of the present invention will be described with reference to FIG. 4 to FIG. 6.

First, in general, in order to prevent image quality deterioration in video display, liquid crystal panels require alternating driving for inversing the polarity of an applied voltage at predetermined intervals. In this case, the polarity of the applied voltage is switched by an alternating-current signal (hereinafter, referred to as M signal). For example, the M signal is inverted between a LOW state and a HIGH state for each scanning period. Here, depending on the liquid crystal panel, the gray scale number-gray scale voltage characteristic with a positive polarity (for example, the M signal is in a LOW state) is different from that with a negative polarity (for example, the M signal is in a HIGH state). Therefore, a desired gamma characteristic adjustment is required for each polarity.

In order to change the setting of the gray scale voltage for each polarity in the configuration of the gray-scale-voltage generating circuit shown in the first embodiment, two types of settings, that is, register settings for the positive polarity and those for the negative polarity in the liquid crystal display are stored, and these settings are synchronized with the M signal to switch the register value to be inputted to the gray-scale-voltage generating unit. By doing so, the gray scale voltages for the positive polarity and the negative polarity can be generated. In this case, however, a setting time from the switch of the gray scale voltage to the convergence thereof depends on the values of the first and second ladder resistances. If these resistance values are too large, convergence cannot be achieved within a predetermined period (for example, within 1 H period) For its solution, the values of the ladder resistances are made small, but this disadvantageously causes a side effect of the increase of a steady-state current.

For its solution, the liquid crystal display having a gamma characteristic adjustment function in this embodiment is provided with an amplitude adjustment function, a gradient adjustment function, a fine adjustment function, a tap adjustment function, and a partial-voltage-ratio adjustment function. Also, first ladder resistances of two systems each shown in the above-described first embodiment are provided. Particularly at the time of the alternating driving, a first ladder resistance for the positive polarity and a first ladder resistance for the negative polarity are previously set, and one of the first ladder resistances of the two systems is switched to the other when the polarity is switched. By doing so, a speed of switching the gray-scale-voltage settings between the positive and negative polarities can be increased.

First, with reference to FIG. 4, an example of the configuration of a gray-scale-voltage generating unit in the liquid crystal display according to this embodiment will be described. FIG. 4 is a block diagram showing the configuration of the gray-scale-voltage generating unit.

In the gray-scale-voltage generating unit in the liquid crystal display according to this embodiment, first ladder resistances of two systems each shown in the first embodiment are provided as an A-ladder resistance 401 and a B-ladder resistance 402 for the gray-scale-voltage generating unit according to the first embodiment. Furthermore, the A-ladder resistance 401 and the B-ladder resistance 402 are provided with an A-ladder setting register 411 and a B-ladder setting register 412, respectively, which independently set a desired gamma characteristic (amplitude adjustment, gradient adjustment, and fine adjustment) for the positive polarity and the negative polarity, respectively. Furthermore, selectors 421 to 428 for selecting either one of tap voltages generated from the A-ladder resistance 401 and the B-ladder resistance 402 are added. Components other than the above, that is, the amplifier circuit 141, the tap selectors 161 and 162, the variable resistances 171 and 172, and the second ladder resistance are identical to those in the configuration in the first embodiment.

More specifically, for the A-ladder resistance 401 and the B-ladder resistance 402 of the two systems, two systems each including the first ladder resistances formed of the resistances 111 to 116, the variable resistances 121 to 124, and the selectors 131 to 136 as shown in FIG. 1 are provided, and outputs from these selectors 131 to 136 of the two systems are selected by the added selectors 421 to 428 and then outputted to the amplifier circuit 141.

Next, with reference to the above-described FIG. 4, an example of an operation of generating a gray scale voltage in the gray-scale-voltage generating unit according to the second embodiment will be described.

The tap voltages are generated in the A-ladder resistance 401 and the B-ladder resistance 402 in the same manner as that in the first ladder resistance described in the first embodiment. In this case, it is assumed that the A-ladder resistance 401 has register settings for the positive polarity and the B-ladder resistance 402 has register settings for the negative polarity. The gamma characteristic adjustment (amplitude adjustment, gradient adjustment, and fine adjustment) of the A-ladder resistance 401 and the B-ladder resistance 402 can be performed in the same manner as that in the first embodiment.

Next, the tap voltages generated by the respective ladder resistances are inputted to the selectors 421 to 428 to switch the above-described M signal as a ladder switching signal 431. For example, when the M signal is in a LOW state, of the tap voltages inputted to the selectors 421 and 428, those all with the positive polarity settings (tap voltages outputted from the A-ladder resistance 401) are selected. On the other hand, when the M signal is in a HIGH state, of the tap voltages inputted to the selectors 421 and 428, those all with the negative polarity settings (tap voltages output from the B-ladder resistance 402) are selected.

The operations thereafter (after tap voltage generation until gray scale voltage generation) are similar to those in the first embodiment.

In this way, with the first ladder resistance including the A-ladder resistance 401 and the B-ladder resistance 402 of the two systems, tap voltages for the positive polarity and those for the negative polarity are generated in advance. By doing so, gray scale voltages for necessary gray scale levels can be generated at high speed upon polarity switching.

Also in this embodiment, effects of the amplitude adjustment function, the gradient adjustment function, the tap adjustment function, and the partial-voltage-ratio adjustment function in the first embodiment shown in FIG. 2A to FIG. 2E can be obtained, and by combining these functions, the conventional gamma characteristic adjustment function and a function to extend the adjustable range of the shoulder portions of the S curve representing the gamma characteristic can be achieved for both positive and negative polarities. Therefore, it is possible to achieve accurate color reproducibility on various liquid crystal panels.

Next, with reference to FIG. 5, an example of the configuration of the liquid crystal display according to this embodiment equipped with the above-described gray-scale-voltage generating unit will be described. FIG. 5 is a block diagram showing the configuration of the liquid crystal display.

The liquid crystal display 300 according to this embodiment is different from that according to the first embodiment in that only the control register 308 and the gray-scale-voltage generating circuit 100 are changed.

Figure 4:
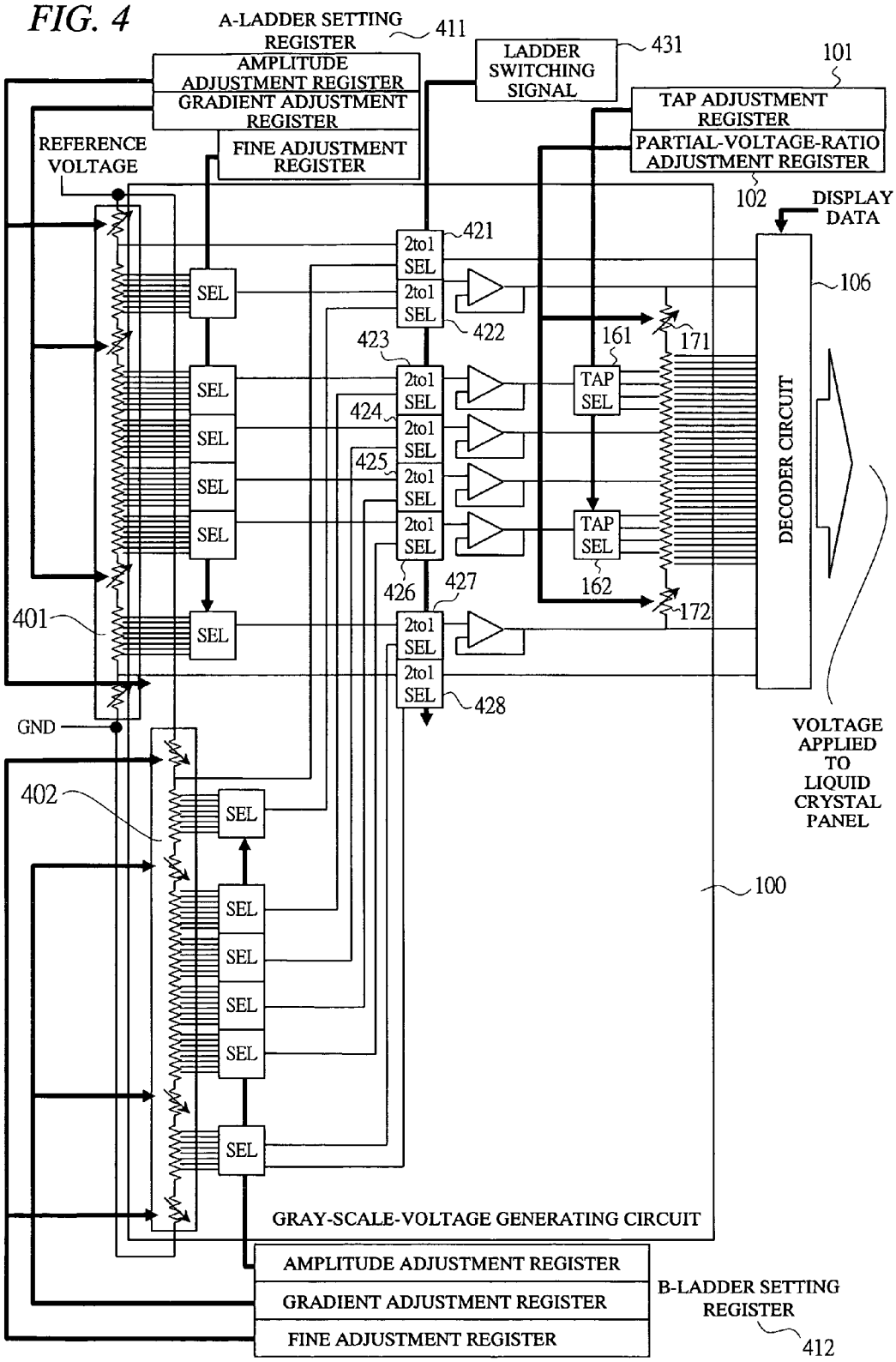
FIG. 4 is a block diagram showing the configuration of a gray-scale-voltage generating unit in a liquid crystal display according to a second embodiment of the present invention.
Figure 5:
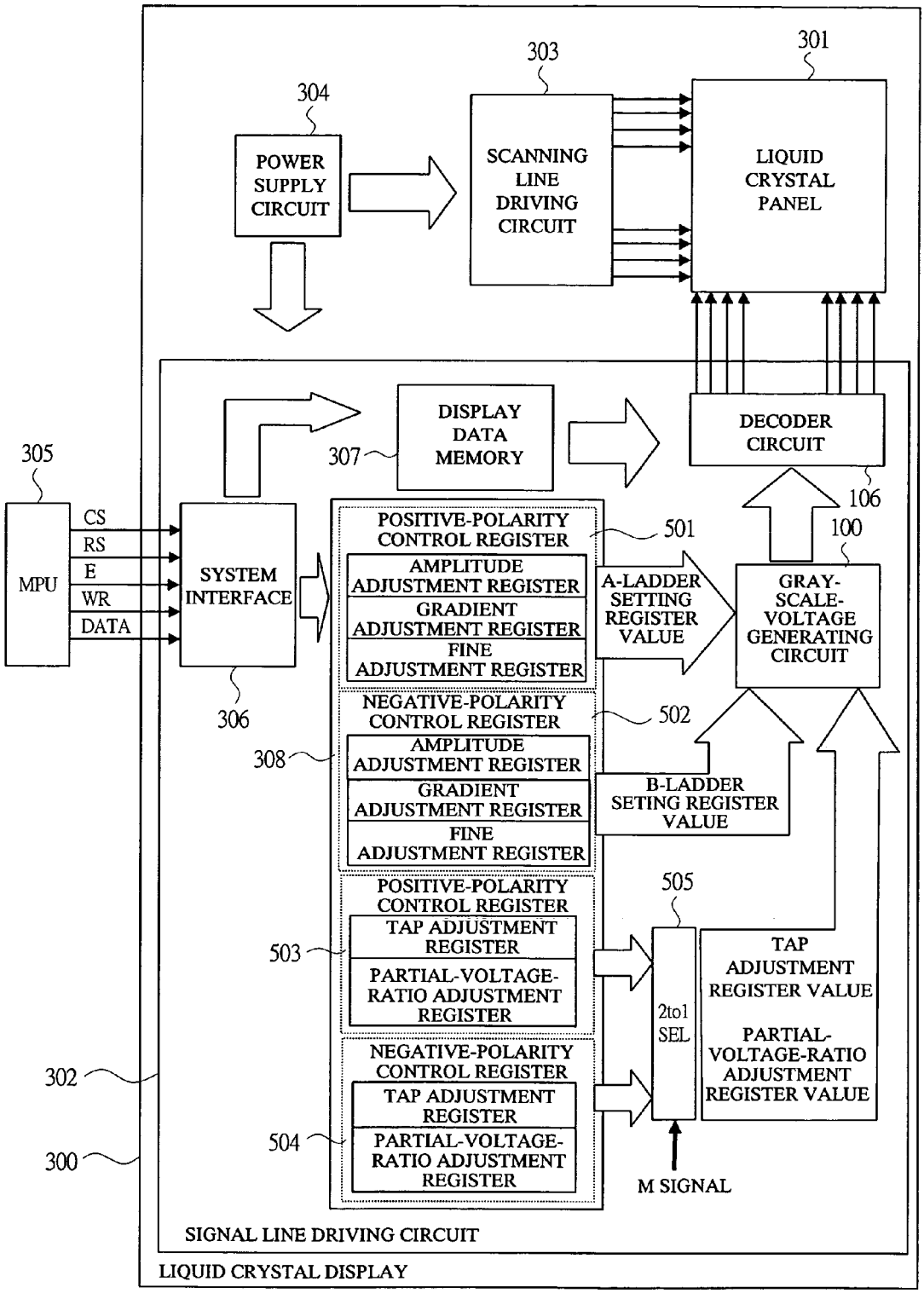
FIG. 5 is a block diagram showing the liquid crystal display according to the second embodiment of the present invention.

The gray-scale-voltage generating circuit 100 has the configuration of the voltage generating circuit described in FIG. 4.

The control register 308 includes: a positive-polarity control register 501 including an amplitude adjustment register, a gradient adjustment register, and a fine adjustment register for the positive polarity; a negative-polarity control register 502 including an amplitude adjustment register, a gradient adjustment register, and a fine adjustment register for the negative polarity; a positive-polarity control register 503 including a tap adjustment register and a partial-voltage-ratio adjustment register for the positive polarity; and a negative-polarity control register 504 including a tap adjustment register and a partial-voltage-ratio adjustment register for the negative polarity.

From the control register 308 to the gray-scale-voltage generating circuit 100, A-ladder setting register values from the above-described positive-polarity control register 501 and B-ladder setting register values from the above-described negative-polarity control register 502 are inputted. Also, the positive-polarity control register 503 and the negative-polarity control register 504 are switched at the selector 505 by the above-described M signal. In this embodiment, it is assumed that the positive-polarity register setting values (control register 503) are selected when the M signal is in a LOW state, and the negative-polarity register setting values (control register 504) are selected when the M signal is in a HIGH state.

Next, with reference to FIG. 6, one example of timings of register setting values inputted from the control register 308 to each register of the gray-scale-voltage generating circuit 100 will be described. FIG. 6 is a timing chart of register setting values.

Figure 6:
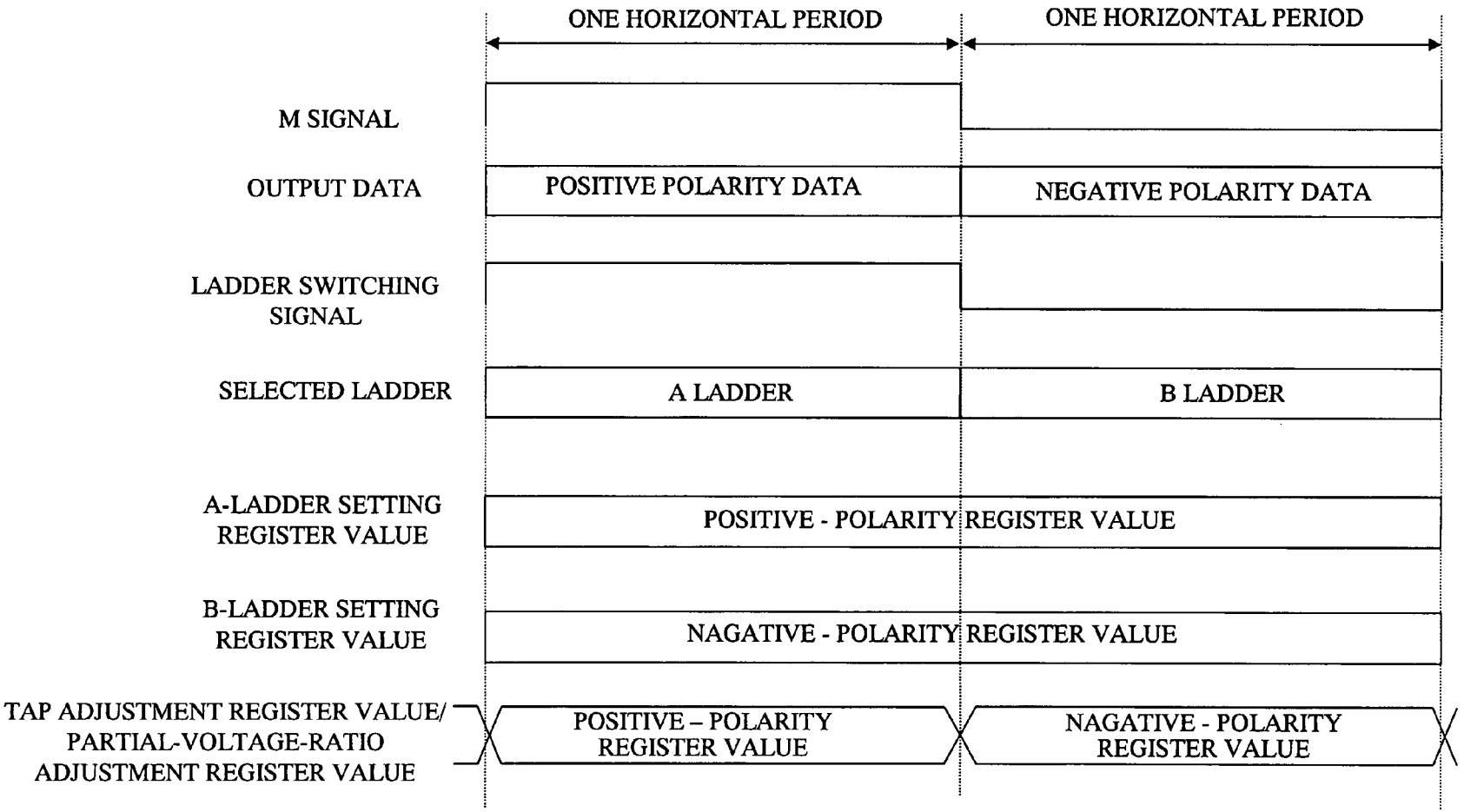
FIG. 6 is a timing chart showing register setting values to be inputted to registers in the liquid crystal display according to the second embodiment of the present invention.

FIG. 6 shows an example of an operation of a control register in polarity inversion driving for each line. In the polarity inversion driving for each line, the polarity of output data is switched between the positive polarity and the negative polarity for each one horizontal period. Therefore, the ladder switching signal 431 has to be changed for each horizontal period so that the A-ladder resistance 401 to which the register setting values of the positive-polarity control register 501 are inputted and the B-ladder resistance 402 to which the register setting values of the negative-polarity control register 502 are inputted are alternately used for each one horizontal period. In this embodiment, the A-ladder resistance 401 is selected when the ladder switching signal 431 is in a HIGH state and the B-ladder resistance 402 is selected when the ladder switching signal 431 is in a LOW state. Also in this embodiment, timing of the ladder switching signal 431 and that of the M signal are equal to each other, and therefore, the M signal may be used as the ladder switching signal.

Next, as for the tap adjustment register and the partial-voltage-ratio adjustment register, the register setting values inputted from the control register 308 to each register of the gray-scale-voltage generating circuit 100 have to be switched between those of the positive-polarity control register 503 and those of the negative-polarity control register 504 for each one horizontal period. This switching can be achieved by using the M signal as described above.

According to the liquid crystal display 300 of the second embodiment described above, two systems of gamma characteristic adjustments for positive and negative polarities are provided in advance, and are switched therebetween in accordance with the M signal which instructs the alternating driving. By doing so, it becomes possible to increase the speed of switching the gray scale voltages corresponding to the positive polarity and the negative polarity. Also, the liquid crystal display 300 includes various types of setting registers such as those for amplitude adjustment, gradient adjustment, fine adjustment, tap adjustment, and partial-voltage-ratio adjustment. Therefore, the register values can be easily varied independently from outside, and each gamma characteristic adjustment can be facilitated. Furthermore, in addition to the conventional gamma characteristic adjustment function, a function capable of further extending the adjustable range of the so-called shoulder portions of the S curve representing the gamma characteristic can be achieved. Therefore, it is possible to achieve the accurate color reproducibility on more various display panels.

Third Embodiment

Figure 7:
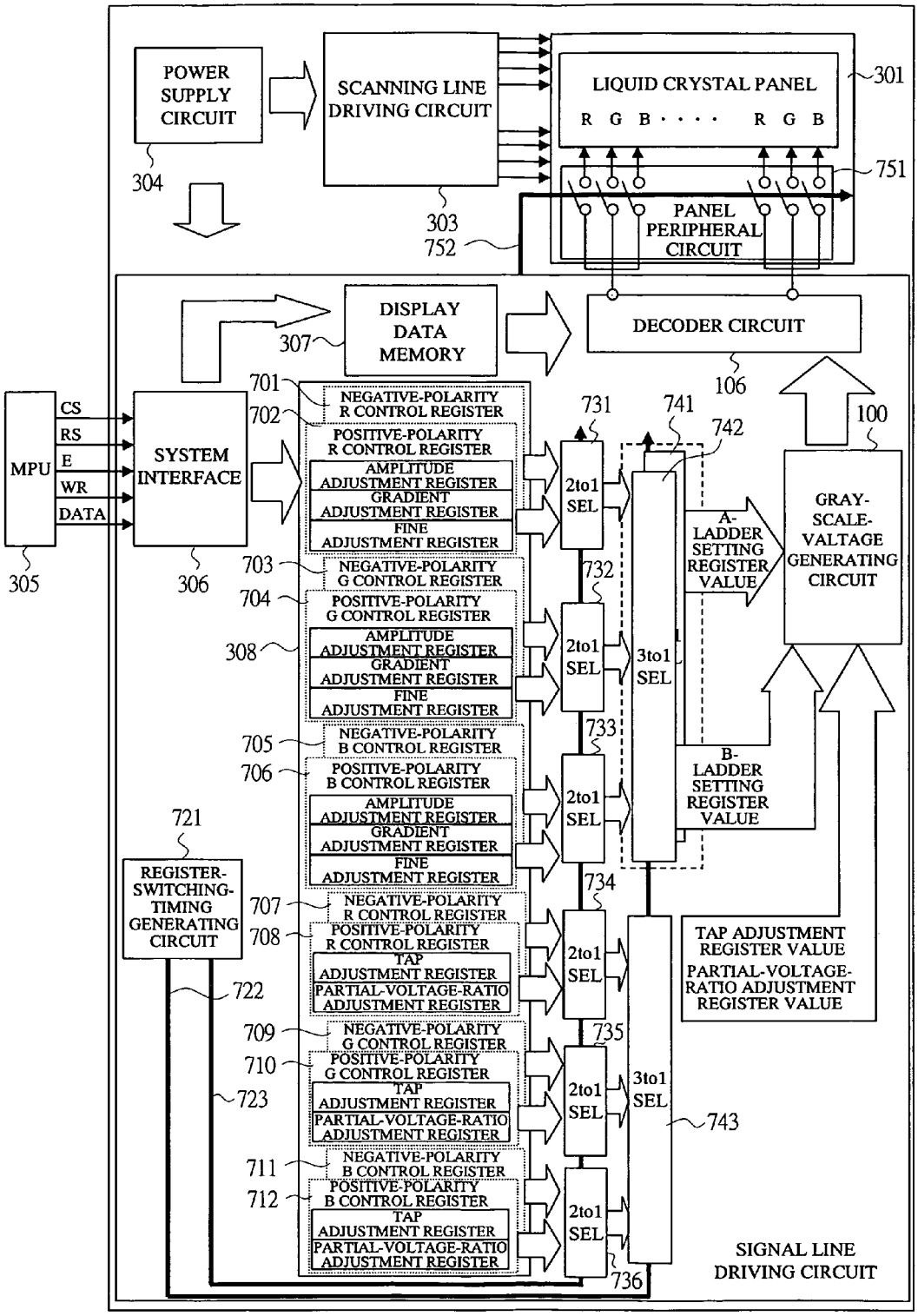
FIG. 7 is a block diagram showing a liquid crystal display according to a third embodiment of the present invention.

A liquid crystal display according to the third embodiment of the present invention will be described with reference to the above-described FIGS. 4, 7 and 8.

First, as a method of driving a color liquid crystal display, a method is known, in which gray scale voltages corresponding to red (R), green (G), and blue (B) are outputted by an signal line driving circuit in a time division manner within one scanning period, and the outputted voltages are demultiplexed by an internal circuit on the liquid crystal panel side. An object of this embodiment is to individually adjust gamma characteristics of the respective R, G, and B colors in the above-described method, thereby achieving high image quality.

For its achievement, the above-described circuit configuration according to the second embodiment is applied. More specifically, in this embodiment, a liquid crystal display having a gamma characteristic adjustment function is provided with an amplitude adjustment function, a gradient adjustment function, a fine adjustment function, a tap adjustment function, a partial-voltage-ratio adjustment function. Also, the liquid crystal display is also provided with the first ladder resistances of two systems described in the second embodiment, wherein the positive polarity and the negative polarity are switched therebetween for each one scanning period, and the gamma characteristic settings for R, G, and B are switched among themselves during one scanning period. The switching of the gamma characteristic settings between the positive polarity and the negative polarity and the switching of the gamma characteristic settings for each of R, G, and B data are achieved by alternately using the first ladder resistances of the two systems.

Next, with reference to FIG. 7, an example of the configuration of the liquid crystal display according to this embodiment equipped with the above-described gray-scale-voltage generating unit will be described. FIG. 7 is a block diagram showing the configuration of the liquid crystal display.

The liquid crystal display 300 according to this embodiment is different from that according to the second embodiment in that only the control register 308 and the liquid crystal panel 301 are changed.

The liquid crystal panel 301 is provided with a switch 751 between signal lines for R/G/B pixels and signal lines inputted from the signal line driving circuit 302. In this case, signal line data inputted from the signal line driving circuit 302 to the liquid crystal panel 301 allows R/G/B data to be inputted in a time division manner within one horizontal period. With a signal line switching signal 752, the liquid crystal panel 301 and an input destination of the signal lines inputted from the signal line driving circuit 302 are switched at the switch 751.

The control register 308 includes: a negative-polarity R control register 701, a negative-polarity G control register 703 and a negative-polarity B control register 705 for negative-polarity R, G, B data, each having the registers for amplitude adjustment, gradient adjustment and fine adjustment; and a positive-polarity R control register 702, a positive-polarity G control register 704 and a positive-polarity B control register 706 for positive-polarity R, G, B data, each having the registers for amplitude adjustment, gradient adjustment and fine adjustment. Also, the control register 308 includes: a negative-polarity R control register 707, a negative-polarity G control register 709 and a negative-polarity B control register 711 for negative-polarity R, G, B data, each having the registers for tap adjustment and partial-voltage-ratio adjustment; and a positive-polarity R control register 708, a positive-polarity G control register 710, and a positive-polarity B control register 712 for positive-polarity R, G, B data, each having the registers for tap adjustment and partial-voltage-ratio adjustment.

The register values of the above-mentioned negative-polarity R control register 701 and positive-polarity R control register 702 are switched therebetween by a selector 731 in accordance with a 2-to-1 switching signal 722 outputted from the register switching timing generating circuit 721. The same is true of the other control registers, and the positive-polarity and negative-polarity registers are switched therebetween in accordance with the 2-to-1 switching signal 722 by using the selectors 732 to 736. Here, switching timing of the selectors 731 to 733 and that of the selectors 734 to 736 are different from each other, which will be described in detail later with reference to FIG. 8.

Next, the register setting values selected by the selectors 731 to 733 are inputted to the selector 741. One of three register values is then selected in accordance with a 3-to-1 switching signal 723 outputted from the register switching timing generating circuit 721, and the selected value is then outputted as an A-ladder setting register value to the gray-scale-voltage generating circuit 100.

Similarly, the register setting values selected by the selectors 731 to 733 are inputted to the selector 742. One of three register values is then selected in accordance with the 3-to-1 switching signal 723 outputted from the register switching timing generating circuit 721, and the selected value is then outputted as a B-ladder setting register value to the gray-scale-voltage generating circuit 100.

Furthermore, the register setting values selected by the selectors 734 to 736 are inputted to the selector 743. One of three register values is then selected in accordance with the 3-to-1 switching signal 723 outputted from the register switching timing generating circuit 721, and the selected value is then outputted as a corresponding one of a tap adjustment register value and a partial-voltage-ratio adjustment register value to the gray-scale-voltage generating circuit 100.

Still further, switching of the register values in these three selectors 741, 742, and 743 is performed at an independent timing. Details of such timing of register value switching will be described below with reference to FIG. 8.

Next, the timing of the register setting values inputted from the above-described control register 308 to each register of the gray-scale-voltage generating circuit 100 will be described with reference to FIG. 8. FIG. 8 is a timing chart of register setting values.

Figure 8:
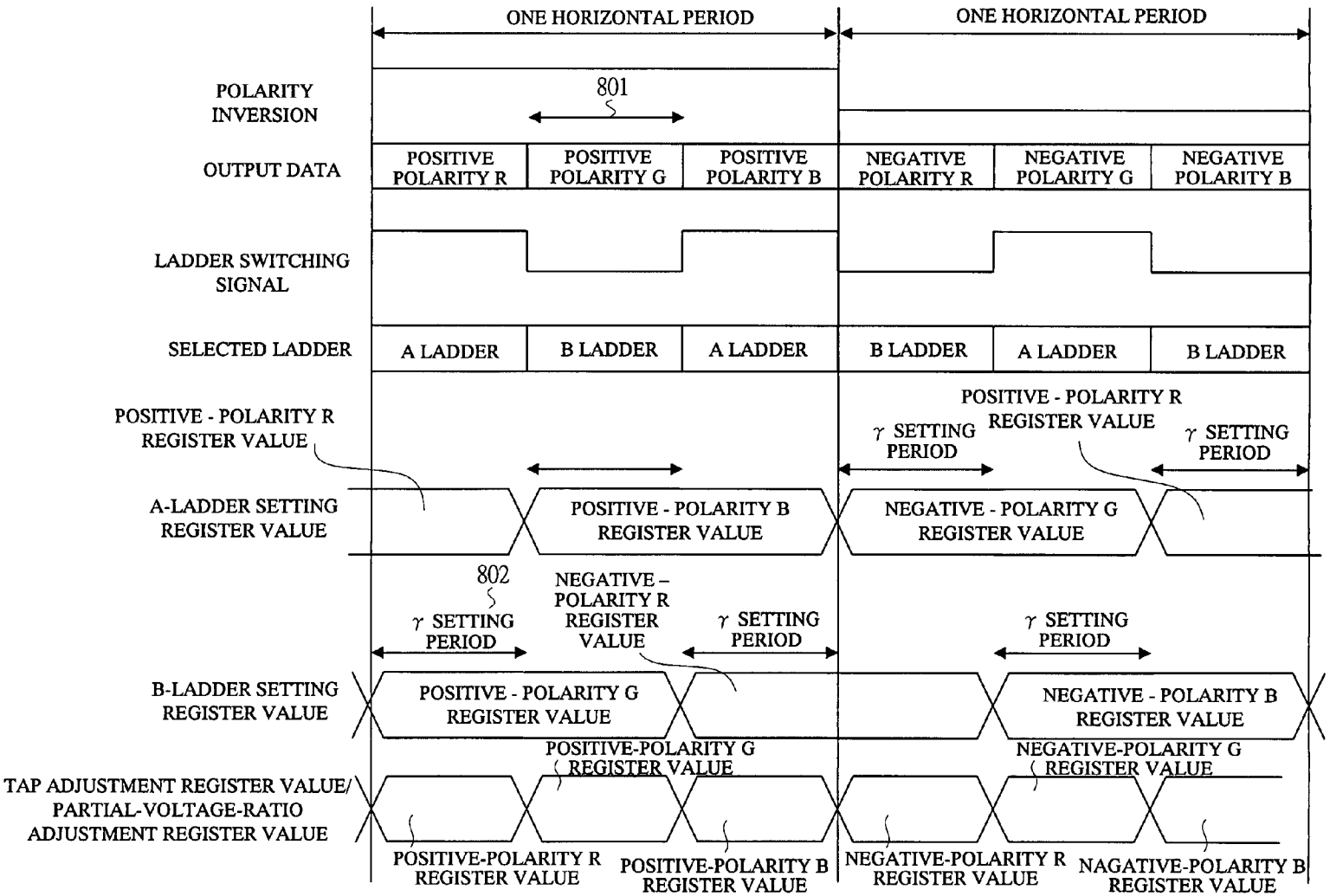
FIG. 8 is a timing chart showing register setting values to be inputted to registers in the liquid crystal display according to the third embodiment of the present invention.

FIG. 8 depicts polarity inversion driving for each line, wherein data is transferred in a RGB time division manner. Therefore, the A-ladder resistance 401 and the B-ladder resistance 402 are switched therebetween for each RGB time division within one horizontal period. At this time, for example, when output data from the signal line driving circuit 302 is positive-polarity G data and the selected ladder resistance is the B-ladder resistance 402 (in a period denoted by a reference numeral 801 in FIG. 8), the register settings of the B-ladder resistance 402 have to be performed during a gamma characteristic setting period 802. With the settings being performed at the above-described timing, in the period 801 where the B-ladder resistance 402 is used, generation of the gray scale voltage at the B-ladder resistance 402 is already in a fixed state. For this reason, similar to the second embodiment described above, no problem occurs in the convergence time at the time of switching. Also, by performing the register setting to the A ladder resistance 401 at a similar timing, similar effects can be obtained.

Next, as for the tap adjustment register and the partial-voltage-ratio adjustment register, the control register is also changed in synchronization with RGB output data. For example, in a period where positive-polarity R data is outputted from the signal line driving circuit 302, a tap adjustment register value and a partial-voltage-ratio adjustment register value are set to a register value of the positive-polarity R data.

According to the embodiment described above, positive-polarity and negative-polarity gamma characteristic adjustment and gamma characteristic adjustment for each of R, G, and B data can be made individually. Also, the first ladder resistances of two systems are alternately used at the time of switching the gamma characteristic settings (at the time of switching between the positive polarity and the negative polarity and at the time of RGB switching). By doing so, a gray scale voltage can be generated at high speed. Furthermore, the liquid crystal display 300 includes various types of setting registers such as those for amplitude adjustment, gradient adjustment, fine adjustment, tap adjustment, and partial-voltage-ratio adjustment. Therefore, since the register values can be easily varied independently from outside, each gamma characteristic adjustment can be facilitated. Still further, in addition to the conventional gamma characteristic adjustment function, a function capable of further extending the adjustable range of the so-called shoulder portions of the S curve representing the gamma characteristic can be achieved. Therefore, it is possible to achieve the accurate color reproducibility on more various display panels.

As a result, according to each of the above-described embodiments, five gamma characteristic adjustment functions including those for tap adjustment and partial-voltage adjustment in addition to the conventional functions for amplitude adjustment, gradient adjustment, and fine adjustment are provided. Therefore, the gamma characteristic can be optimally and easily adjusted on various liquid crystal panels, and high image quality and versatility can be realized.

Fourth Embodiment

A liquid crystal display according to a fourth embodiment of the present invention will be described with reference to FIG. 9 to FIG. 12.

In the fourth embodiment, if the tap selector switches used in the above-described first, second, and third embodiments cannot be used in the second ladder resistance, a curve adjustment function is added before the amplifier circuit that outputs a tap voltage. With this, similar to the tap adjustment function, the so-called shoulder portions of the S curve that are close to the reference voltage and the ground are flexibly adjusted more than ever before. By doing so, a desired gray scale voltage level can be obtained. Thus, an object of this embodiment is to achieve accurate color reproducibility for various liquid crystal panels.

For its achievement, instead of using the tap selector switches used in the above-described first, second, and third embodiments in the second ladder resistance, a curve adjustment function is added before the amplifier circuit that outputs a tap voltage.

In the internal configuration of the tap selector used in the first, second, and third embodiments, connection is made so that a tap voltage is outputted to the inside of the second ladder resistance, and select switches formed of Metal-Oxide Field-Effect Transistors (hereinafter referred to as MOSFETs) are provided within the connection. Here, the above-mentioned tap voltage is divided by a combined resistance of a resistance value of the second ladder resistance and a so-called ON resistance when the MOSFET switch is turned to an ON state. Therefore, it is desirable that the resistance value of the second ladder resistance be sufficiently increased in comparison with the ON resistance of the MOSFET so as to minimize an error of the tap voltage. However, if the resistance value of the second ladder resistance is increased, the time in which the voltage is settled at the time of the switching of a gray scale voltage becomes long. Thus, depending on an output load of the second ladder resistance, the resistance value may not be sufficiently increased.

To solve the problem of the voltage error, in the fourth embodiment according to the present invention, an adjustment function equivalent to the tap adjustment function is provided before the amplifier circuit for impedance transformation. Note that, the adjustment of shoulder portions of the S curve before the amplifier can be achieved by extending the voltage level adjustable width of the tap voltage that determines the shoulder portions of the S curve.

More specifically, by changing a resistive division ratio at which the first ladder resistance is divided, the voltage level width inputted to the selector circuit is changed to determine the shoulder portions of the S curve. Alternatively, by changing a resistive division ratio at which the first ladder resistance is divided, the voltage level inputted to the selector circuit is parallelly moved on the upper or lower side to determine the shoulder portions of the S curve.

Figure 9:
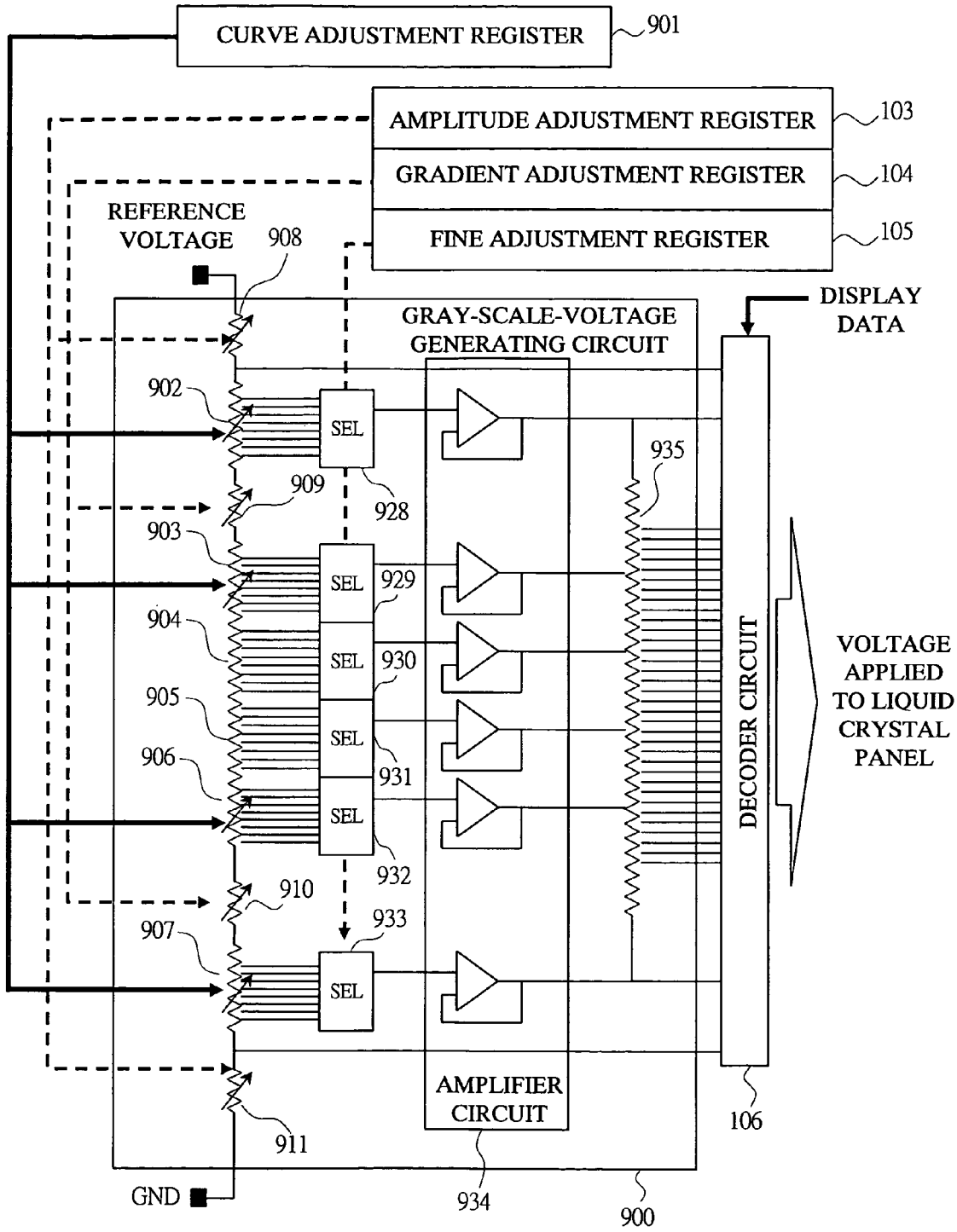
FIG. 9 is a block diagram showing the configuration of a gray-scale-voltage generating unit in a liquid crystal display according to a fourth embodiment of the present invention.

Next, with reference to FIG. 9, an example of the circuit configuration having the curve adjustment function in the gray-scale-voltage generating unit will be described. FIG. 9 is a block diagram showing the gray-scale-voltage generating unit.

The gray-scale-voltage generating unit in the liquid crystal display according to this embodiment includes: a gray-scale-voltage generating circuit 900 that generates a plurality of internally-generated reference voltages by dividing a reference voltage and generates a plurality of gray scale voltages corresponding to a plurality of gray scale levels by dividing the plurality of internally-generated reference voltages; a curve adjustment register 901 that sets a value for adjusting a dividing point or a dividing ratio of the reference voltage in order to extend a voltage level setting width of a tap voltage close to each of end portions of the gamma characteristic; the amplitude adjustment register 103, the gradient adjustment register 104; the fine adjustment register 105; and the decoder circuit 106 that have been described with reference to FIG. 1.

The gray-scale-voltage generating circuit 900 includes: a first ladder resistance formed of variable resistance groups 902, 903, 906, and 907 each having a plurality of variable resistances and resistances 904 and 905 which are connected in series between a connecting end of a reference voltage and a connecting end of the ground; variable resistances 908 and 911 connected in series to the first ladder resistance at the side of the connecting end of the reference voltage and at the side of the connecting end of the ground, respectively; variable resistances 909 and 910 connected in series to the first ladder resistance in intermediate portions of the first ladder resistance; selectors (SELs) 928 to 933 similar to those described above with reference to FIG. 1; an amplifier circuit 934; and a second ladder resistance 935.

Figure 10:
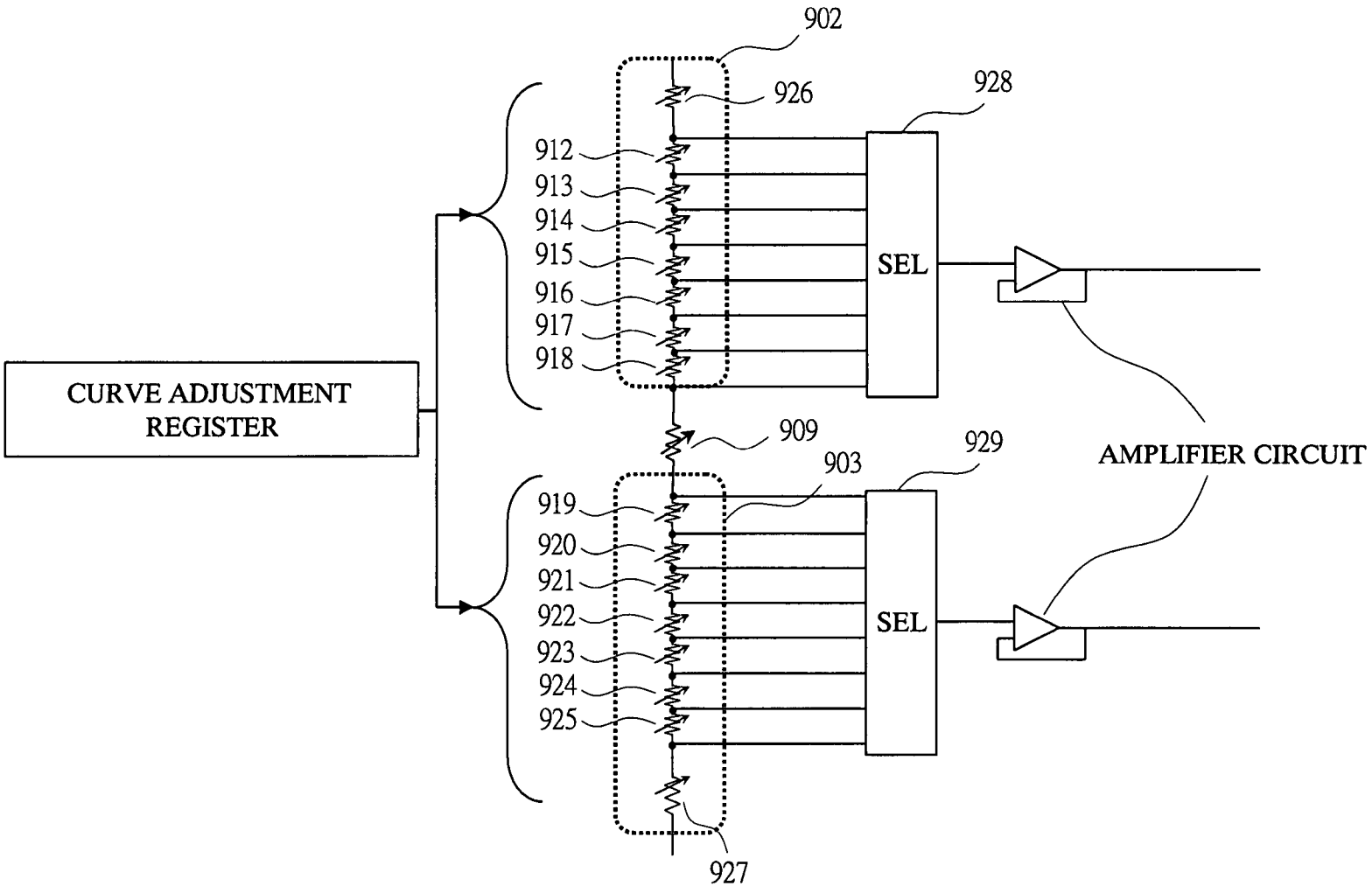
FIG. 10 is a block diagram showing variable resistance groups in the liquid crystal display according to the fourth embodiment of the present invention.

Next, with reference to FIG. 10, the configuration of the variable resistance groups 902 and 903 will be described. FIG. 10 is a block diagram showing the configuration of the variable resistance groups.

The variable resistance group 902 close to the reference voltage side includes: variable resistances 912 to 918 that are configured among voltage lines connected to the selector 928 for supplying a plurality of voltage levels so as to change the resistance value among the voltage lines; and a variable resistance 926 that is connected in series to the above-described voltage lines and the variable resistances 912 to 918 at the reference voltage side.

The variable resistance group 903 close to the reference voltage side includes: variable resistances 919 to 925 that are configured among voltage lines connected to the selector 929 for supplying a plurality of voltage levels so as to change the resistance value among the voltage lines; and a variable resistance 927 that is connected in series to the above-described voltage lines and the variable resistances 919 to 925 at the ground side.

Here, the configuration of the variable resistance group 906 is similar to that of the variable resistance group 902, and the configuration of the variable resistance group 907 is similar to that of the variable resistance group 903. Therefore, descriptions of these variable resistance groups 906 and 907 are omitted.

Next, the curve adjustment function will be described. Here, the basic principle of gray scale voltage generation in the gray-scale-voltage generating circuit according to this embodiment is as described above with reference to FIG. 1. Also, the amplitude adjustment function, the gradient adjustment function, and the fine adjustment function are similar to those in the conventional technology. Therefore, descriptions of the basic principle and these functions are omitted.

First, a register value is inputted from the curve adjustment register 901 provided outside the gray-scale-voltage generating circuit 900. With the inputted digital data, the variable resistances 912 to 918 and 926 included in the variable resistance group 902 or the variable resistances 919 to 925 and 927 included in the variable resistance group 903 are simultaneously set. At this time, it is preferable that the ratio of each of the variable resistances 912 to 918 be always kept constant. The same is true of the variable resistances 919 to 925. It is further preferable that a total of the changed variable resistance values be set so as to be always constant and an immediately-above voltage level on the reference voltage side of the variable resistance group 902 and an immediately-below voltage level on the ground side of the variable resistance group 903 be set so as to constant.

Similarly, with the register value inputted from the curve adjustment register 901, the variable resistances included in the above-described variable resistance group 906 and the variable resistances included in the above-described variable resistance group 907 are simultaneously set. At this time, it is preferable that a total of the changed variable resistance values be set so as to be always constant.

In the case of the settings as described above, effects of the curve adjustment function will be described with reference to FIGS. 11 and 12.

FIG. 11 is a table that depicts a relation between a curve adjustment register value and a variable resistance value. FIG. 12 is a graph that depicts changes in the gray scale number-gray scale voltage characteristic representing the gamma characteristic when the curve adjustment register value is changed while fixing register values other than those for curve adjustment.

First, effects when the variable resistances 912 to 918 and 919 to 925 are changed while fixing the values of the variable resistances 926 and 927 ("OR" in the drawing) will be described. In this case, R represents a basic resistance value, and a resistance value in the order of 10 kΩ to 20 kΩ is generally used for R.

First, when the value is changed from 000 to 011 of FIG. 11, the resistance values of the variable resistances 912 to 918 in the variable resistance group 902 are gradually decreased, whereas the resistance values of the variable resistances 919 to 925 in the variable resistance group 903 are increased. In this case, the gray scale voltage level selected at the selector 929 is increased as the resistance values of the variable resistances 912 to 918 are decreased. Furthermore, in accordance with the decrease of the resistance values of the variable resistances 912 to 918, the resistance values of the variable resistances 919 to 925 are increased so that the total of the variable resistance values is always kept constant. By doing so, the immediately-above voltage level of the variable resistance group 902 on the reference voltage side and the immediately-below voltage level of the variable resistance group 903 on the ground side become constant. Therefore, the voltage levels of the tap voltages selected by the selectors 930 and 931 and intermediate gray scale levels included therebetween are not changed.

The results are shown in FIG. 12 as the changes in the gray scale number-gray scale voltage characteristic. First, a characteristic curve 1001 of FIG. 12 is a characteristic curve formed by a conventional gray-scale-voltage generating circuit without a curve adjustment function. When values of 000 to 011 of the curve adjustment register shown in FIG. 11 are inputted to the pair of the variable resistance groups 902 and 903 of FIG. 9, characteristic curves corresponding to these are those denoted by 1002 to 1005. As shown in FIG. 12, only the shoulder portion of the S curve at the reference voltage side of the gamma characteristic is gradually raised to the upper side. On the other hand, when values of 000 to 011 of the curve adjustment register shown in FIG. 11 are inputted to the pair of the variable resistance groups 906 and 907 of FIG. 9, characteristic curves corresponding to these are those denoted by 1008 to 1011. As shown in FIG. 12, only the shoulder portion of the S curve at the ground side of the gamma characteristic is gradually raised to the upper side.

Next, effects when a resistance component is inserted in either one of the variable resistances 926 and 927 will be described.

First, when the value of the curve adjustment register is 100 shown in FIG. 11, the variable resistance 926 included in the variable resistance group 902 indicates 7R, and the variable resistance 927 included in the variable resistance group 903 indicates OR. In this case, the gray scale voltage levels selected by the selectors 928 and 929 are both parallelly moved on the ground side. On the other hand, when the value of the curve adjustment register is 101 shown in FIG. 11, the variable resistance 926 included in the variable resistance group 902 indicates OR, and the variable resistance 927 included in the variable resistance group 903 indicates 7R. In this case, the gray scale voltage levels selected by the selectors 928 and 929 are both parallelly moved on the reference voltage side. Here, also in the case of setting 100 or 101 to the value of the curve adjustment register, similar to the case of the setting values 000, 001, 010, and 011 of the curve adjustment register, the resistance values of the variable resistances 912 to 918 and 919 to 925 are set so that the total of the variable resistance values is always constant. Therefore, the voltage levels of the tap voltages selected by the selectors 930 and 931 and intermediate gray scale levels included therebetween are not changed.

According to FIG. 12 showing the results as the changes in the gray scale number-gray scale voltage characteristic, characteristic curves corresponding to the setting value 100 of the curve adjustment register are those denoted by 1006 and 1012. As shown in FIG. 12, only the shoulder portion of the S curve at the ground side of the gamma characteristic is lowered to the ground side. Also, characteristic curves corresponding to the setting value 101 of the curve adjustment register are those denoted by 1007 and 1013. As shown in FIG. 12, only the shoulder portion of the S curve at the ground side of the gamma characteristic is raised to the reference voltage side.

As a result, according to this embodiment, four types of gamma characteristic adjustment functions, that is, curve adjustment in addition to the conventional amplitude adjustment, gradient adjustment, and fine adjustment are provided. Therefore, the gamma characteristic can be optimally and easily adjusted on various liquid crystal panels, and the high image quality and versatility can be achieved.

Note that, also in the configuration including the curve adjustment function as described in this embodiment, similar to the second embodiment, if two systems of gamma characteristic adjustments for positive and negative polarities are provided in advance and these systems are switched therebetween in accordance with the M signal instructing the alternating driving, it is possible to increase the speed of switching the gray scale voltage corresponding to the positive polarity and the negative polarity. Furthermore, by applying the configuration as described in the third embodiment, the gamma characteristic adjustments between the positive polarity and the negative polarity and the gamma characteristic adjustments for each of R, G, and B data can be individually adjusted.

Also, in this embodiment, eight voltage lines are connected to each selector (SEL). Therefore, seven variable resistances 912 to 918 or 919 to 925 are provided. Alternatively, when the number of voltage lines is increased or decreased, the number of variable resistances may be increased or decreased accordingly. Also, the variable resistance values used in the variable resistance group are not limited to those used in this embodiment, and the same effects can be expected with other values.

Furthermore, in this embodiment, the variable resistance groups 902 and 903 are considered as a pair and the variable resistance groups 906 and 907 are considered as a pair, and each resistance value is set so that the total of the resistance values in each pair is not changed. However, even if the total of the resistance values in each pair is changed, the voltage level width of the tap voltage of the shoulder portions of the S curve can be extended, and therefore, the object of this embodiment can be achieved. These settings can be arbitrarily made through register settings.

Furthermore, in this embodiment, only four types of gamma characteristic adjustment functions, that is, curve adjustment in addition to the conventional amplitude adjustment, gradient adjustment, and fine adjustment are provided. However, partial-voltage-ratio adjustment described in the first, second, and third embodiments can be added without any problem.

Still further, the gray-scale-voltage generating circuit according to this embodiment can be incorporated in the configuration of the liquid crystal displays according to the first, second, and third embodiments.

In the foregoing, the invention made by the inventors of the present invention has been concretely described based on the embodiments. However, it is needless to say that the present invention is not limited to the foregoing embodiments and various modifications and alterations can be made within the scope of the present invention.

For example, it is assumed in the above-described liquid crystal display that the liquid crystal panel is in a normally black mode. However, the present invention can be achieved regardless of the above mode. Also, although description has been made based on the premise that the number of gray scale levels is 32, an arbitrary number of gray scale levels may be used. Furthermore, the present invention is not limited to a liquid crystal display, but can be applied to a display that controls a display brightness level by an applied voltage, such as an organic EL display.

What is claimed is:

1. A display driver for outputting a gray scale voltage corresponding to display data representing a gray scale level to a display panel on which a plurality of pixels are arranged, the display driver comprising:

a generating circuit for generating a plurality of gray scale voltages corresponding to a plurality of gray scale levels from a reference voltage;

a decoder circuit for selecting a gray scale voltage corresponding to said display data from said plurality of gray scale voltages;

a first register for setting a first control value of said generating circuit for generating said plurality of gray scale voltages from said reference voltage in order to adjust an amplitude of a gamma characteristics curve, in a graph having a vertical axis representing a gray scale voltage and a horizontal axis representing a gray scale number, which determines a relation between said gray scale levels and said gray scale voltages or brightness levels on said display panel;

a second register for setting a second control value of said generating circuit for generating said plurality of gray scale voltages from said reference voltage in order to adjust a gradient of intermediate portions of said gamma characteristics curve, which intermediate portions are located between end portions of said gamma characteristics curve, a third register for setting a third control value of said generating circuit for generating said plurality of gray scale voltages from said reference voltage in order to finely adjust the intermediate portions of said gamma characteristics curve for each gray scale level;

a fourth register, different from said first, second and third registers, for setting a fourth control value of said generating circuit for generating said plurality of gray scale voltages from said reference voltage in order to adjust a gray scale level in a horizontal direction parallel to said horizontal axis, with respect to a gray scale voltage in the intermediate portions close to the end portions of said gamma characteristics curve without changing a voltage amplitude of the gamma characteristics curve, and a fifth register, different from said first, second and third registers for setting a fifth control value of said generating circuit for generating said plurality of gray scale voltages from said reference voltage in order to adjust a gray scale voltage ratio among a plurality of gray scale levels in said intermediate portions close to both end portions of the gamma characteristics curve without changing the gradient of the gamma characteristics curve in said intermediate portions.

2. The display driver according to claim 1, wherein the control values of said first to fifth registers can be set independently from outside.

3. The display driver according to claim 1, wherein said gamma characteristics curve is represented by an approximately S curve, said fourth register can adjust a gray scale level with respect to a gray scale voltage in the intermediate portions of said gamma characteristics curve including curved points of said approximately S curve, and said fifth register can adjust a gray scale voltage ratio among a plurality of gray scale levels in the intermediate portions of said gamma characteristics curve located between the curved points and both ends of said approximately S curve.

4. The display driver according to claim 1, wherein said generating circuit includes: a first ladder resistance connected between a connecting end of a first reference voltage and a connecting end of a second reference voltage; first variable resistances connected in series to said first ladder resistance at a position close to a side of the connecting end of said first reference voltage and a position close to a side of the connecting end of said second reference voltage; second variable resistances connected in series to said first ladder resistance in intermediate portions of said first ladder resistance; first selectors for selecting an output from said first ladder resistance; an amplifier connected to an output side of said first selectors; second selectors selecting an input of said decoder circuit to connect an output from said amplifier to said input; a second ladder resistance connected to a plurality of inputs of said decoder circuit; and third variable resistances connected in series to said second ladder resistance between said second ladder resistance and the inputs of said decoder circuit, resistance values of said first variable resistance can be varied based on said first control value in said first register, resistances values of said second variable resistance can be varied based on said second control value in said second register, said first selector can select an output from said first ladder resistance based on said third control value in said third register, said second selector can select an input point of said decoder circuit based on said fourth control value in said fourth register, and resistance values of said third variable resistances can be varied based on said fifth control value in said fifth register.

5. The display driver according to claim 4, wherein said generating circuit includes two systems each including said first ladder resistance, said first variable resistances, said second variable resistances, and said first selectors, and further includes third selectors for selecting an output from said first selectors of said two systems to output the selected one to said amplifier, resistance values of said first variable resistances of said two systems can be varied based on said first control value in said first register and a sixth control value in a sixth register which has the same function as said first register, resistance values of said second variable resistances of said two systems can be varied based on said second control value in said second register and a seventh control value in a seventh register which has the same function as said second register, said first selectors of said two systems can select an output from said first ladder resistance based on said third control value in said third register and an eighth control value in an eighth register which has the same function as said third register, said third selector can select an output from said first selector based on a first switching signal, and said two systems are alternately used at predetermined periods, and during a period in which one of said two systems is used, settings of the other system are switched to those corresponding to a next period.

6. The display driver according to claim 5, wherein periods in which said two systems are alternately used correspond to a change in polarity of said pixels on said display panel.

7. The display driver according to claim 6, wherein said polarity of said pixels on said display panel is changed in any one of common inversion driving, column inversion driving, and dot inversion driving.

8. The display driver according to claim 5, wherein the predetermined period of said two systems is a period divided into three corresponding to each color of red, green, and blue, said generating circuit includes: said third selectors for selecting the output from said first selectors of said two systems; and fourth selectors for selecting a three-divided output from said third selectors to output the selected one to said amplifier, resistance values of said first variable resistances of said three-divided two systems can be varied based on said first control value in said first register, said sixth control value in said sixth register, and ninth to twelfth control values in ninth to twelfth registers which have the same function as said first register, resistance values of said second variable resistances of said three-divided two systems can be varied based on said second control value in said second register, said seventh control value in said seventh register, and thirteenth to sixteenth control values in thirteenth to sixteenth registers which have the same function as said second register, said first selectors of said three-divided two systems can select an output from said first ladder resistance based on said third control value in said third register, said eighth control value in said eighth register, and seventeenth to twentieth control values in seventeenth to twentieth registers which have the same function as said third register, said third selectors can select the output from said first selectors based on said first switching signal, and said fourth selectors can select an output from said third selectors based on a second switching signal.

9. The display driver according to claim 8, further comprising: a timing generating circuit for generating said first and second switching signals.

10. The display driver according to claim 4, wherein a plurality of said first to third variable resistances are provided.

11. A display driver for outputting a gray scale voltage corresponding to display data representing a gray scale level to a display panel on which a plurality of pixels are arranged, the display driver comprising:

a generating circuit for generating a plurality of internally-generated reference voltages by dividing a reference voltage and generating a plurality of gray scale voltages corresponding to a plurality of gray scale levels by dividing said plurality of internally-generated reference voltages;

a decoder circuit for selecting a gray scale voltage corresponding to said display data from said plurality of gray scale voltages;

a first register for setting a first control value for adjusting a dividing point or a dividing ratio of said reference voltage in order to adjust an amplitude of a gamma characteristics curve, in a graph having a vertical axis representing a gray scale voltage and a horizontal axis representing a gray scale number, which determines a relation between said gray scale levels and said gray scale voltages or brightness levels on said display panel;

a second register for setting a second control value for adjusting the dividing point or the dividing ratio of said reference voltage in order to adjust a gradient of intermediate portions of said gamma characteristics curve, which intermediate portions are located between end portions of said gamma characteristics curve, a third register for setting a third control value for adjusting the dividing point or the dividing ratio of said reference voltage in order to finely adjust the intermediate portions of said gamma characteristics curve for each gray scale level; and a fourth register, different from said first, second and third registers, for setting a fourth control value for adjusting the dividing point or the dividing ratio of said reference voltage in order to adjust a setting range of said third control value for adjusting said gamma characteristics curve, wherein said generating circuit includes: a first ladder resistance connected between a connecting end of a first reference voltage and a connecting end of a second reference voltage; first variable resistances connected in series to said first ladder resistance at a position close to a side of the connecting end of said first reference voltage and a position close to a side of the connecting end of said second reference voltage; second variable resistances connected in series to said first ladder resistance in intermediate portions of said first ladder resistance; first selectors for selecting an output from said first ladder resistance; third variable resistances which are a part of said first ladder resistance and positioned between lines connected from said first ladder resistance to said first selectors; an amplifier connected to an output side of said first selectors; and a second ladder resistance connected to a plurality of inputs of said decoder circuit, resistance values of said first variable resistances can be varied based on said first control value in said first register, resistance values of said second variable resistances can be varied based on said second control value in said second register, said first selector can select an output from said first ladder resistance based on said third control value in said third register, and resistance values of said third variable resistances can be varied based on said fourth control value in said fourth register.

12. The display driver according to claim 11, wherein said gamma characteristic is represented by an approximately S curve, and said fourth register can adjust a setting range of said third control value in intermediate portions of said gamma characteristic including curved points of said approximately S curve.

13. The display driver according to claim 11, wherein said generating circuit includes two systems each including said first ladder resistance, said first variable resistances, said second variable resistances, said first selectors, and said third variable resistances, and further includes second selectors for selecting an output from said first selectors of said two systems to output the selected one to said amplifier, resistance values of said first variable resistances of said two systems can be varied based on said first control value in said first register and a fifth control value in a fifth register which has the same function as said first register, resistance values of said second variable resistances of said two systems can be varied based on said second control value in said second register and a sixth control value in a sixth register which has the same function as said second register, said first selectors of said two systems can select an output from said first ladder resistance based on said third control value in said third register and a seventh control value in a seventh register which has the same function as said third register, resistance values of the third variable resistances of said two systems can be varied based on said fourth control value in said fourth register and an eighth control value in an eighth register which has the same function as said fourth register, said second selector can select an output from said first selector based on a first switching signal, and said two systems are alternately used at predetermined periods, and during a period in which one of said two systems is used, settings of the other system are switched to those corresponding to a next interval.

14. The display driver according to claim 13, wherein periods in which said two systems are alternately used correspond to a change in polarity of said pixels on said display panel.

15. The display driver according to claim 14, wherein said polarity of the pixels on said display panel is changed in any one of common inversion driving, column inversion driving, and dot inversion driving.

16. The display driver according to claim 13, wherein the predetermined period of said two systems is a period divided into three corresponding to each color of red, green, and blue, said generating circuit includes: said second selectors for selecting the output from said first selectors of said two systems; and third selectors for selecting a three-divided output from said second selectors to output the selected one to said amplifier, resistance values of said first variable resistances of said three-divided two systems can be varied based on said first control value in said first register, said fifth control value in said fifth register, and ninth to twelfth control values in ninth to twelfth registers which have the same function as said first register, resistance values of said second variable resistances of said three-divided two systems can be varied based on said second control value in said second register, said sixth control value in said sixth register, and thirteenth to sixteenth control values in thirteenth to sixteenth registers which have the same function as said second register, said first selectors of said three-divided two systems can select an output from said first ladder resistance based on said third control value in said third register, said seventh control value in said seventh register, and seventeenth to twentieth control values in seventeenth to twentieth registers which have the same function as said third register, resistance values of said third variable resistances of said two systems can be varied based on said fourth control value in said fourth register, said eighth control value in said eighth register, and twenty-first to twenty-fourth control values in twenty-first to twenty-fourth registers which have the same function as said fourth register, said second selector can select an output from said first selector based on said first switching signal, and said third selector can select an output from said second selector based on a second switching signal.

17. The display driver according to claim 16, further comprising: a timing generating circuit for generating said first and second switching signals.

18. The display driver according to claim 11, wherein a plurality of said first to third variable resistances are provided.

19. The display driver according to claim 3, wherein the fourth register is configured to permit adjustment of curvature of the S curve in a horizontal direction when the S curve is represented as a graph having a vertical axis representing the gray scale voltage and a horizontal axis representing gray scale number.

20. The display driver according to claim 19, wherein the third register is configured to permit adjustment of the curvature of the S curve in a vertical direction on said graph such that two dimensional adjustment of the curvature of the S curve is permitted by operation of the third register and the fourth register.

21. The display driver according to claim 3, wherein said generating circuit includes: a first ladder resistance connected between a connecting end of a first reference voltage and a connecting end of a second reference voltage; first variable resistances connected in series to said first ladder resistance at a position close to a side of the connecting end of said first reference voltage and a position close to a side of the connecting end of said second reference voltage; second variable resistances connected in series to said first ladder resistance in intermediate portions of said first ladder resistance; first selectors for selecting an output from said first ladder resistance; an amplifier connected to an output side of said first selectors; second selectors selecting an input of said decoder circuit to connect an output from said amplifier to said input; a second ladder resistance connected to a plurality of inputs of said decoder circuit; and third variable resistances connected in series to said second ladder resistance between said second ladder resistance and the inputs of said decoder circuit, resistance values of said first variable resistance can be varied based on said first control value in said first register, resistances values of said second variable resistance can be varied based on said second control value in said second register, said first selector can select an output from said first ladder resistance based on said third control value in said third register, said second selector can select an input point of said decoder circuit based on said fourth control value in said fourth register, and resistance values of said third variable resistances can be varied based on said fifth control value in said fifth register.

22. The display driver according to claim 21, wherein the fourth register is configured to permit adjustment of curvature of the S curve in a horizontal direction when the S curve is represented as a graph having a vertical axis representing the gray scale voltage and a horizontal axis representing gray scale number.

23. The display driver according to claim 22, wherein the third register is configured to permit adjustment of the curvature of the S curve in a vertical direction on said graph such that two dimensional adjustment of the curvature of the S curve is permitted by operation of the third register and the fourth register.

24. A display driver for outputting a gray scale voltage corresponding to display data representing a gray scale level to a display panel on which a plurality of pixels are arranged, the display driver comprising:

a generating circuit for generating a plurality of gray scale voltages corresponding to a plurality of gray scale levels from a reference voltage;

a decoder circuit for selecting a gray scale voltage corresponding to said display data from said plurality of gray scale voltages;

a first register for setting a first control value of said generating circuit for generating said plurality of gray scale voltages from said reference voltage in order to adjust an amplitude of a gamma characteristics curve, in a graph having a vertical axis representing a gray scale voltage and a horizontal axis representing a gray scale number, which determines a relation between said gray scale levels and said gray scale voltages or brightness levels on said display panel;

a second register for setting a second control value of said generating circuit for generating said plurality of gray scale voltages from said reference voltage in order to adjust a gradient of intermediate portions of said gamma characteristics curve, which intermediate portions are located between end portions of said gamma characteristics curve, a third register for setting a third control value of said generating circuit for generating said plurality of gray scale voltages from said reference voltage in order to finely adjust the intermediate portions of said gamma characteristics curve for each gray scale level;

a fourth register for setting a fourth control value of said generating circuit for generating said plurality of gray scale voltages from said reference voltage in order to adjust a gray scale level, with respect to a gray scale voltage in the intermediate portions close to the end portions of said gamma characteristics curve, and a fifth register for setting a fifth control value of said generating circuit for generating said plurality of gray scale voltages from said reference voltage in order to adjust a gray scale voltage ratio among a plurality of gray scale levels in said intermediate portions close to both end portions of the gamma characteristics curve, wherein said generating circuit includes: a first ladder resistance connected between a connecting end of a first reference voltage and a connecting end of a second reference voltage; first variable resistances connected in series to said first ladder resistance at a position close to a side of the connecting end of said first reference voltage and a position close to a side of the connecting end of said second reference voltage; second variable resistances connected in series to said first ladder resistance in intermediate portions of said first ladder resistance; first selectors for selecting an output from said first ladder resistance; an amplifier connected to an output side of said first selectors; second selectors selecting an input of said decoder circuit to connect an output from said amplifier to said input; a second ladder resistance connected to a plurality of inputs of said decoder circuit; and third variable resistances connected in series to said second ladder resistance between said second ladder resistance and the inputs of said decoder circuit, resistance values of said first variable resistance can be varied based on said first control value in said first register, resistances values of said second variable resistance can be varied based on said second control value in said second register, said first selector can select an output from said first ladder resistance based on said third control value in said third register, said second selector can select an input point of said decoder circuit based on said fourth control value in said fourth register, and resistance values of said third variable resistances can be varied based on said fifth control value in said fifth register.

25. A display driver for outputting a gray scale voltage corresponding to display data representing a gray scale level to a display panel on which a plurality of pixels are arranged, the display driver comprising:

a generating circuit for generating a plurality of gray scale voltages corresponding to a plurality of gray scale levels from a reference voltage;

a decoder circuit for selecting a gray scale voltage corresponding to said display data from said plurality of gray scale voltages;

a first register for setting a first control value of said generating circuit for generating said plurality of gray scale voltages from said reference voltage in order to adjust an amplitude of a gamma characteristics curve, in a graph having a vertical axis representing a gray scale voltage and a horizontal axis representing a gray scale number, which determines a relation between said gray scale levels and said gray scale voltages or brightness levels on said display panel;

a second register for setting a second control value of said generating circuit for generating said plurality of gray scale voltages from said reference voltage in order to adjust a gradient of intermediate portions of said gamma characteristics curve, which intermediate portions are located between end portions of said gamma characteristics curve, a third register for setting a third control value of said generating circuit for generating said plurality of gray scale voltages from said reference voltage in order to finely adjust the intermediate portions of said gamma characteristics curve for each gray scale level;

a fourth register for setting a fourth control value of said generating circuit for generating said plurality of gray scale voltages from said reference voltage in order to adjust a gray scale level, with respect to a gray scale voltage in the intermediate portions close to the end portions of said gamma characteristics curve, and a fifth register for setting a fifth control value of said generating circuit for generating said plurality of gray scale voltages from said reference voltage in order to adjust a gray scale voltage ratio among a plurality of gray scale levels in said intermediate portions close to both end portions of the gamma characteristics curve, wherein said gamma characteristics curve is represented by an approximately S curve, said fourth register can adjust a gray scale level with respect to a gray scale voltage in the intermediate portions of said gamma characteristics curve including curved points of said approximately S curve, and said fifth register can adjust a gray scale voltage ratio among a plurality of gray scale levels in the intermediate portions of said gamma characteristics curve located between the curved points and both ends of said approximately S curve, wherein said generating circuit includes: a first ladder resistance connected between a connecting end of a first reference voltage and a connecting end of a second reference voltage; first variable resistances connected in series to said first ladder resistance at a position close to a side of the connecting end of said first reference voltage and a position close to a side of the connecting end of said second reference voltage; second variable resistances connected in series to said first ladder resistance in intermediate portions of said first ladder resistance; first selectors for selecting an output from said first ladder resistance; an amplifier connected to an output side of said first selectors; second selectors selecting an input of said decoder circuit to connect an output from said amplifier to said input; a second ladder resistance connected to a plurality of inputs of said decoder circuit; and third variable resistances connected in series to said second ladder resistance between said second ladder resistance and the inputs of said decoder circuit, resistance values of said first variable resistance can be varied based on said first control value in said first register, resistances values of said second variable resistance can be varied based on said second control value in said second register, said first selector can select an output from said first ladder resistance based on said third control value in said third register, said second selector can select an input point of said decoder circuit based on said fourth control value in said fourth register, and resistance values of said third variable resistances can be varied based on said fifth control value in said fifth register.

* * * * *